US012331944B2

(12) United States Patent
Fujimoto et al.

(10) Patent No.: US 12,331,944 B2
(45) Date of Patent: Jun. 17, 2025

(54) REFRIGERANT CIRCUIT APPARATUS EVALUATION SYSTEM

(71) Applicant: DAIKIN INDUSTRIES, LTD., Osaka (JP)

(72) Inventors: Shuji Fujimoto, Osaka (JP); Akihiro Inao, Osaka (JP); Shizuka Sadai, Osaka (JP); Shinichi Kasahara, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 264 days.

(21) Appl. No.: 18/077,827

(22) Filed: Dec. 8, 2022

(65) Prior Publication Data

US 2023/0098410 A1 Mar. 30, 2023

Related U.S. Application Data

(63) Continuation of application No. PCT/JP2021/021337, filed on Jun. 4, 2021.

(30) Foreign Application Priority Data

Jun. 11, 2020 (JP) ..... 2020-101904

(51) Int. Cl.
*F24F 11/30* (2018.01)

(52) U.S. Cl.
CPC ..... *F24F 11/30* (2018.01)

(58) Field of Classification Search
CPC ..... F24F 11/30; F24F 11/46; F24F 2110/10; F24F 2110/12; F25B 13/00;
(Continued)

(56) References Cited

U.S. PATENT DOCUMENTS

2010/0198415 A1* 8/2010 Kawano ..... F25B 45/00 700/282
2022/0178569 A1* 6/2022 Fujimoto ..... F24F 11/86

FOREIGN PATENT DOCUMENTS

JP 2000-28181 A 1/2000
JP 2002-349926 A 12/2002
(Continued)

OTHER PUBLICATIONS

International Search Report (PCT/ISA/210) issued in PCT/JP2021/021337, dated Aug. 17, 2021.
(Continued)

*Primary Examiner* — Marc E Norman
(74) *Attorney, Agent, or Firm* — Birch, Stewart, Kolasch & Birch, LLP

(57) ABSTRACT

Providing a refrigerant circuit apparatus evaluation system, which, when a plurality of refrigerant circuit apparatuses is installed, may accurately determine whether a heat source unit of each refrigerant circuit apparatus adversely affects the operation of a different refrigerant circuit apparatus. A refrigerant circuit apparatus evaluation system includes memory and processing circuitry. The processing circuitry acquires operation data on a first air-conditioning apparatus. The first air-conditioning apparatus includes a first heat source unit. The processing circuitry determines whether an operation of a second heat source unit different from the first heat source unit has an adverse effect on an operation of the first heat source unit based on the operation data on the first air-conditioning apparatus acquired by the processing circuitry when the first air-conditioning apparatus and a second air-conditioning apparatus including the second heat source unit are simultaneously operating.

8 Claims, 5 Drawing Sheets

(58) Field of Classification Search
CPC ..... F25B 2313/0314; F25B 2313/0315; F25B 2400/06; F25B 2700/2104; F25B 2700/2106
See application file for complete search history.

(56) References Cited

FOREIGN PATENT DOCUMENTS

| | | | |
|---|---|---|---|
| JP | 2005-221179 | A | 8/2005 |
| JP | 2011-43255 | A | 3/2011 |

OTHER PUBLICATIONS

Written Opinion of the International Search Authority (PCT/ISA/237) for PCT/JP2021/021337, dated Aug. 17, 2021.
International Preliminary Report on Patentability and English translation of the Written Opinion of the International Searching Authority for International Application No. PCT/JP2021/021337, dated Dec. 22, 2022.
Extended European Search Report for European Application No. 21821225.6 dated Oct. 9, 2023.

* cited by examiner

REFRIGERANT CIRCUIT APPARATUS EVALUATION SYSTEM

CROSS REFERENCE TO RELATED APPLICATIONS

This application is a Continuation of PCT International Application No. PCT/JP2021/021337, filed on Jun. 4, 2021, which claims priority under 35 U.S.C. 119(a) to Patent Application No. 2020-101904, filed in Japan on Jun. 11, 2020, all of which are hereby expressly incorporated by reference into the present application.

TECHNICAL FIELD

The present disclosure relates to a refrigerant circuit apparatus evaluation system. More specifically, the present disclosure relates to a refrigerant circuit apparatus evaluation system that determines whether an installation state of a heat source unit in a refrigerant circuit apparatus is appropriate.

BACKGROUND ART

Conventionally, as in Patent Literature 1 (Japanese Unexamined Patent Publication No. 2000-028181), a plurality of refrigerant circuit apparatuses may be installed in one building, one facility, etc.

SUMMARY

A refrigerant circuit apparatus evaluation system according to an aspect includes an acquisition unit and a determination unit. The acquisition unit is configured to acquire operation data on a first refrigerant circuit apparatus. The first refrigerant circuit apparatus includes a first heat source unit. The determination unit is configured to determine whether an operation of a second heat source unit different from the first heat source unit has an adverse effect on an operation of the first heat source unit based on the operation data on the first refrigerant circuit apparatus acquired by the acquisition unit when the first refrigerant circuit apparatus and a second refrigerant circuit apparatus including the second heat source unit are simultaneously operating.

DESCRIPTION OF EMBODIMENTS

A refrigerant circuit apparatus evaluation system 100 according to an embodiment of the present disclosure will be described with reference to the drawings.

(1) Overall Configuration

An overview of the refrigerant circuit apparatus evaluation system 100 according to the embodiment of the present disclosure and a first air-conditioning apparatus 1A and a second air-conditioning apparatus 1B, which are evaluation targets of the refrigerant circuit apparatus evaluation system 100, will be described with reference to FIGS. 1 to 3.

Figure 1:
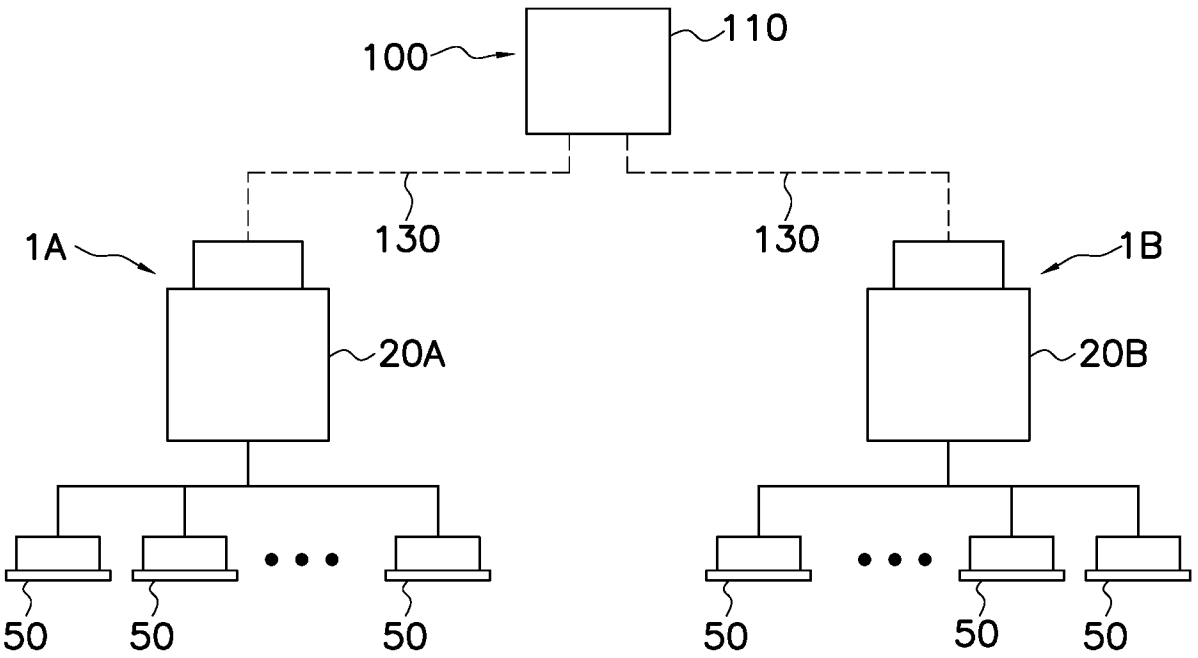
FIG. 1 is a diagram schematically illustrating an overall configuration including a refrigerant circuit apparatus evaluation system according to an embodiment of the present disclosure, a first air-conditioning apparatus, and a second air-conditioning apparatus.

FIG. 1 is a diagram schematically illustrating an overall configuration including the refrigerant circuit apparatus evaluation system 100 and the first air-conditioning apparatus 1A and the second air-conditioning apparatus 1B, which are evaluation targets of the refrigerant circuit apparatus evaluation system 100. FIG. 2 is a schematic configuration diagram of the first air-conditioning apparatus 1A and the second air-conditioning apparatus 1B. FIG. 3 is a block diagram of the refrigerant circuit apparatus evaluation system 100, the first air-conditioning apparatus 1A, and the second air-conditioning apparatus 1B.

According to the present embodiment, the refrigerant circuit apparatus evaluation system 100 is a system that determines whether the operation of a second heat source unit 20B of the second air-conditioning apparatus 1B has an adverse effect on the operation of a first heat source unit 20A of the first air-conditioning apparatus 1A. Alternatively or additionally, the refrigerant circuit apparatus evaluation system 100 may be a system that determines whether the operation of the first heat source unit 20A of the first air-conditioning apparatus 1A has an adverse effect on the operation of the second heat source unit 20B of the second air-conditioning apparatus 1B. According to the present embodiment, in order to avoid redundant descriptions, the case where the refrigerant circuit apparatus evaluation system 100 is a system that determines whether the operation of the second heat source unit 20B of the second air-conditioning apparatus 1B, which is an example of a second refrigerant circuit apparatus, has an adverse effect on the first heat source unit 20A of the first air-conditioning apparatus 1A, which is an example of a first refrigerant circuit apparatus, is described as an example.

The refrigerant circuit apparatus evaluation system 100 primarily includes an evaluation apparatus 110. The evaluation apparatus 110 is, for example, but not limited thereto, a computer installed in a building or facility where the first air-conditioning apparatus 1A and the second air-conditioning apparatus 1B are installed. Details of the refrigerant circuit apparatus evaluation system 100 will be described below.

As described above, according to the present embodiment, the first air-conditioning apparatus 1A is an example of the first refrigerant circuit apparatus, and the second air-conditioning apparatus 1B is an example of the second refrigerant circuit apparatus. Furthermore, the refrigerant circuit apparatus is an apparatus that uses a vapor-compression refrigeration cycle to cool or heat an object. In particular, according to the present embodiment, the refrigerant circuit apparatus is an apparatus that uses air as a heat source and uses a vapor-compression refrigeration cycle to cool or heat an object. The first air-conditioning apparatus 1A and the second air-conditioning apparatus 1B according to the present embodiment cool or heat the air as the object to cool or heat the air-conditioning target spaces of the respective air-conditioning apparatuses 1A and 1B. Further, the first air-conditioning apparatus 1A and the second air-conditioning apparatus 1B do not need to be air-conditioning apparatuses capable of both cooling and heating. For example, the first air-conditioning apparatus 1A and the second air-conditioning apparatus 1B may be air-conditioning apparatuses dedicated to cooling.

Further, the first refrigerant circuit apparatus and the second refrigerant circuit apparatus according to the present disclosure are not limited to air-conditioning apparatuses. For example, the first refrigerant circuit apparatus and the second refrigerant circuit apparatus may be chillers, hot water supply apparatuses, cooling apparatuses for freezers or refrigerators, and cooling apparatuses or heating apparatuses for industrial processes.

According to the present embodiment, the first air-conditioning apparatus 1A and the second air-conditioning apparatus 1B are apparatuses installed at the same site (the same building or the same facility). The first air-conditioning apparatus 1A and the second air-conditioning apparatus 1B are for example, but not limited thereto, apparatuses that perform air conditioning on different floors in the same building. For example, but not limited thereto, the first air-conditioning apparatus 1A is used for air conditioning on a first floor of a building and the second air-conditioning apparatus 1B is used for air conditioning on a second floor of the building. Here, the first heat source unit 20A of the first air-conditioning apparatus 1A and the second heat source unit 20B of the second air-conditioning apparatus 1B are arranged close to each other. For example, but not limited thereto, the first heat source unit 20A and the second heat source unit 20B are installed close to each other on a roof floor of the building where the first air-conditioning apparatus 1A and the second air-conditioning apparatus 1B are installed or around the building where the first air-conditioning apparatus 1A and the second air-conditioning apparatus 1B are installed.

Furthermore, in the example described here, in order to simplify the description, the two refrigerant circuit apparatuses (the air-conditioning apparatuses 1A and 1B) are installed at the same site, but the refrigerant circuit apparatus evaluation system 100 is also advantageous in a case where three or more refrigerant circuit apparatuses are installed at the same site. Although the application is not limited, the refrigerant circuit apparatus evaluation system 100 is particularly advantageous in a case where the heat source units of the refrigerant circuit apparatuses are installed in a limited place and a large number of heat source units of the refrigerant circuit apparatuses need to be installed in a relatively small place.

According to the present embodiment, the first air-conditioning apparatus 1A and the second air-conditioning apparatus 1B have the same configuration. Therefore, in order to simplify the description, in the description and drawings below, the same reference numerals are used for components, devices, and the like, included in the first air-conditioning apparatus 1A and the second air-conditioning apparatus 1B except for the reference numeral 20A indicating the heat source unit of the first air-conditioning apparatus 1A, the reference numeral 20B indicating the heat source unit of the second air-conditioning apparatus 1B, the reference numeral 60A indicating a control unit of the first air-conditioning apparatus 1A, and the reference numeral 60B indicating a control unit of the second air-conditioning apparatus 1B. Further, the different reference numerals are used for the first heat source unit 20A of the first air-conditioning apparatus 1A and the second heat source unit 20B of the second air-conditioning apparatus 1B for convenience of the description, but the heat source units 20A and 20B have the same function. Moreover, the different reference numerals are used for the control unit 60A of the first air-conditioning apparatus 1A and the control unit 60B of the second air-conditioning apparatus 1B for convenience of the description, but the control units 60A and 60B have the same function. Details of the air-conditioning apparatuses 1A and 1B will be described below.

Further, the first air-conditioning apparatus 1A and the second air-conditioning apparatus 1B do not need to have the same configuration. For example, the first air-conditioning apparatus 1A and the second air-conditioning apparatus 1B may have different configurations from each other.

(2) Detailed Configuration of First Air-Conditioning Apparatus

A detailed configuration of the first air-conditioning apparatus 1A will be described. As described above, the first air-conditioning apparatus 1A and the second air-conditioning apparatus 1B have the same structure and specification. Therefore, only the first air-conditioning apparatus 1A will be described here, and the description of the second air-conditioning apparatus 1B will be omitted.

Figure 2:
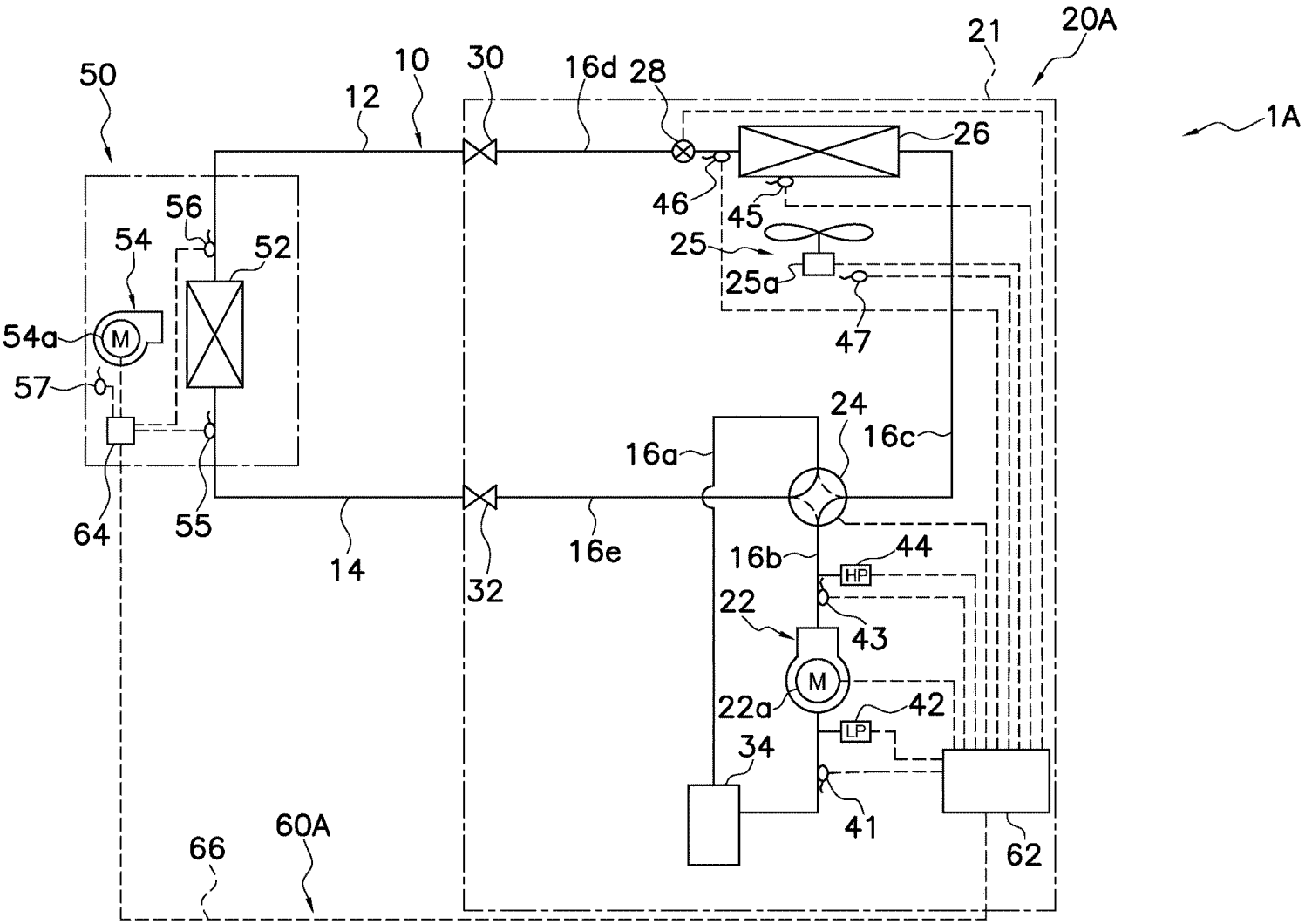
FIG. 2 is a schematic configuration diagram of the first air-conditioning apparatus and the second air-conditioning apparatus.

The first air-conditioning apparatus 1A primarily includes the first heat source unit 20A, a utilization unit 50, a liquid refrigerant connection pipe 12, a gas refrigerant connection pipe 14, and the control unit 60A (see FIG. 2). The liquid refrigerant connection pipe 12 and the gas refrigerant connection pipe 14 are pipes that connect the first heat source unit 20A and the utilization unit 50 (see FIG. 2). The control unit 60A controls operations of various devices and various components of the first heat source unit 20A and the utilization unit 50.

Furthermore, although only the one utilization unit 50 is illustrated in FIG. 2, the first air-conditioning apparatus 1A according to the present embodiment may include the plurality of utilization units 50 as illustrated in FIG. 1. In the example described below, in order to simplify the description, the number of the utilization units 50 is one. Furthermore, although the first air-conditioning apparatus 1A according to the present embodiment includes the one first heat source unit 20A as illustrated in FIG. 2, the number of the first heat source units 20A is not limited to one. The first air-conditioning apparatus 1A may include the two or more first heat source units 20A. Further, for example, the first air-conditioning apparatus 1A may be an integrated apparatus in which the first heat source unit 20A and the utilization unit 50 are incorporated into a single casing.

The first heat source unit 20A and the utilization unit 50 are connected via the liquid refrigerant connection pipe 12 and the gas refrigerant connection pipe 14 to form a refrigerant 5 circuit 10 (see FIG. 2). A refrigerant is sealed in the refrigerant circuit 10. The refrigerant sealed in the refrigerant circuit 10 is not limited, but is for example a fluorocarbon-based refrigerant such as R32. The refrigerant circuit 10 includes a compressor 22, a flow direction switching mechanism 24, a heat-source heat exchanger 26, and an expansion mechanism 28 in the first heat source unit 20A and a utilization heat exchanger 52 in the utilization unit 50 (see FIG. 2).

The first air-conditioning apparatus 1A has, as primary operating modes, a cooling operating mode for performing a cooling operation and a heating operating mode for performing a heating operation. The cooling operation is an operation that causes the heat-source heat exchanger 26 to function as a condenser and causes the utilization heat exchanger 52 to function as an evaporator to cool the air in the air-conditioning target space of the utilization unit 50. The heating operation is an operation that causes the heat-source heat exchanger 26 to function as an evaporator and causes the utilization heat exchanger 52 to function as a condenser to cool the air in the air-conditioning target space of the utilization unit 50.

(2-1) Utilization Unit

The utilization unit 50 is installed in, but not limited thereto, the air-conditioning target space. For example, the utilization unit 50 is of a ceiling-recessed type. Further, the utilization unit 50 is not limited to a ceiling-recessed type and may be, for example, a ceiling-suspended type, a wall-mounted type, or a floor-mounted type.

Furthermore, for example, the utilization unit 50 may be installed outside the air-conditioning target space. For example, the entire utilization unit 50 may be installed behind the ceiling. Moreover, for example, the utilization unit 50 may be installed in a machine chamber. When the utilization unit 50 is installed outside the air-conditioning target space, the first air-conditioning apparatus 1A includes an air passage to supply the air, which is obtained by heat exchange with the refrigerant in the utilization heat exchanger 52, from the utilization unit 50 to the air-conditioning target space. The air passage is, for example, a duct. Furthermore, the type of air passage is not limited to a duct and may be selected as appropriate.

As described above, the utilization unit 50 is connected to the first heat source unit 20A via the liquid refrigerant connection pipe 12 and the gas refrigerant connection pipe 14 to form part of the refrigerant circuit 10.

The utilization unit 50 primarily includes the utilization heat exchanger 52, a second fan 54 driven by a fan motor 54*a*, various sensors (sensors 55, 56, and 57), and a second control unit 64 (see FIG. 2). According to the present embodiment, the various sensors included in the utilization unit 50 include the first temperature sensor 55, the second temperature sensor 56, and the space temperature sensor 57 (see FIG. 2). The second control unit 64 controls the operation of the utilization unit 50.

(2-1-1) Utilization Heat Exchanger

The utilization heat exchanger 52 executes heat exchange between the refrigerant flowing through the utilization heat exchanger 52 and the air in the air-conditioning target space. The type of the utilization heat exchanger 52 is not limited, but is for example a fin-and-tube type heat exchanger including a plurality of heat transfer tubes and fins (not illustrated).

One end of the utilization heat exchanger 52 is connected to the liquid refrigerant connection pipe 12 via a refrigerant pipe. The other end of the utilization heat exchanger 52 is connected to the gas refrigerant connection pipe 14 via a refrigerant pipe. During the cooling operation, the refrigerant flows into the utilization heat exchanger 52 from the heat-source heat exchanger 26 via the liquid refrigerant connection pipe 12, and the utilization heat exchanger 52 functions as an evaporator. During the heating operation, the refrigerant flows into the utilization heat exchanger 52 from the compressor 22 via the gas refrigerant connection pipe 14, and the utilization heat exchanger 52 functions as a condenser (radiator).

(2-1-2) Second Fan

The second fan 54 suctions the air in the air-conditioning target space into a casing (not illustrated) of the utilization unit 50, supplies the air to the utilization heat exchanger 52, and blows out the air having exchanged heat with the refrigerant in the utilization heat exchanger 52 into the air-conditioning target space. The second fan 54 is, for example, a turbo fan. Further, the type of the second fan 54 is not limited to a turbo fan and may be selected as appropriate. The second fan 54 is driven by the fan motor 54*a*. The second fan 54 is a variable air volume fan driven by the fan motor 54*a* that is capable of changing the number of revolutions.

(2-1-3) Sensor

The utilization unit 50 includes the first temperature sensor 55, the second temperature sensor 56, and the space temperature sensor 57 as sensors (see FIG. 2). The type of temperature sensor may be selected as appropriate.

Furthermore, the utilization unit 50 may include only some of the sensors 55 to 57. Further, the utilization unit 50 may include a sensor other than the sensors 55 to 57.

The first temperature sensor 55 is provided in a refrigerant pipe connecting the utilization heat exchanger 52 and the gas refrigerant connection pipe 14. The first temperature sensor 55 measures the temperature of the refrigerant flowing through the refrigerant pipe connecting the utilization heat exchanger 52 and the gas refrigerant connection pipe 14.

The second temperature sensor 56 is provided in a refrigerant pipe connecting the 5 utilization heat exchanger 52 and the liquid refrigerant connection pipe 12. The second temperature sensor 56 measures the temperature of the refrigerant flowing through the refrigerant pipe connecting the utilization heat exchanger 52 and the liquid refrigerant connection pipe 12.

The space temperature sensor 57 is provided on an air suction side of the casing (not illustrated) of the utilization unit 50. The space temperature sensor 57 detects the temperature (a space temperature Tr) of the air in the air-conditioning target space, which flows into the casing of the utilization unit 50.

(2-1-4) Second Control Unit

The second control unit 64 controls the operation of each unit included in the utilization unit 50.

The second control unit 64 includes a microcomputer provided to control the utilization unit 50, a memory that stores a control program executable by the microcomputer, etc. Furthermore, the configuration of the second control unit 64 described here is merely an example, and, for example, the function of the second control unit 64 described below may be implemented by software, hardware, or a combination of software and hardware.

The second control unit 64 is electrically connected to the second fan 54, the first temperature sensor 55, the second temperature sensor 56, and the space temperature sensor 57 to enable an exchange of control signals and information (see FIG. 2).

The second control unit 64 is configured to be able to receive various signals transmitted from a remote controller (not illustrated) for operating the utilization unit 50. The various signals transmitted from the remote controller include signals for giving instructions to operate or stop the utilization unit 50 and signals regarding various settings. The signals regarding various settings include, for example, switching signals for operating modes and signals regarding a set temperature Trs for the cooling operation and heating operation.

The second control unit 64 is connected to the first control unit 62 of the first heat source unit 20A via a transmission line 66 to enable an exchange of control signals, etc. Further, the second control unit 64 and the first control unit 62 do not need to be connected to each other via the physical transmission line 66 and may be connected to each other to enable wireless communications. The second control unit 64 and the first control unit 62 cooperate with each other to function as the control unit 60A that controls the operation of the first air-conditioning apparatus 1A. The control unit 60A will be described below.

(2-2) Heat Source Unit

The first heat source unit 20A takes the air outside the air-conditioning target space into a casing 21 and uses the air taken into the casing 21 as a heat source to cool or heat the refrigerant flowing through the heat-source heat exchanger 26. Further, the first heat source unit 20A exhausts the air having exchanged heat with the refrigerant (the air heated by the refrigerant when the refrigerant is cooled, or the air cooled by the refrigerant when the refrigerant is heated) to the outside of the casing 21 of the first heat source unit 20A. For example, the first heat source unit 20A takes in the air through an intake port provided on a side surface of the casing 21 and exhausts the air through an exhaust port provided in an upper portion of the casing 21. Alternatively, the first heat source unit 20A may take in the air through an intake port provided on one side surface of the casing 21 and exhaust the air through an exhaust port provided on another side surface of the casing 21.

The first heat source unit 20A and the second heat source unit 20B, which is not described here, are installed, for example, on the roof floor of the building where the first air-conditioning apparatus 1A and the second air-conditioning apparatus 1B are installed or around the building. The first heat source unit 20A and the second heat source unit 20B are arranged adjacent to each other, for example. Alternatively, one of the first heat source unit 20A and the second heat source unit 20B may be provided above the other one of the first heat source unit 20A and the second heat source unit 20B. For example, one of the first heat source unit 20A and the second heat source unit 20B may be installed on a stand that is provided above it. Further, in some cases, the first heat source unit 20A and the second heat source unit 20B may be installed apart from each other. However, the size of the place where the heat source units 20A and 20B are installed, the arrangement of other equipment provided in the place, or the like, may put some restrictions. Therefore, an exhaust position of one of the first heat source unit 20A and the second heat source unit 20B may be relatively close to the intake position of the other one of the first heat source unit 20A and the second heat source unit 20B. The refrigerant circuit apparatus evaluation system 100 is particularly advantageous when the first heat source unit 20A and the second heat source unit 20B are installed close to each other.

The first heat source unit 20A is connected to the utilization unit 50 via the liquid refrigerant connection pipe 12 and the gas refrigerant connection pipe 14. The first heat source unit 20A, together with the utilization unit 50, forms the refrigerant circuit 10 (see FIG. 2).

The first heat source unit 20A primarily includes the compressor 22, the flow direction switching mechanism 24, the heat-source heat exchanger 26, the expansion mechanism 28, an accumulator 34, a first shutoff valve 30, a second shutoff valve 32, and a first fan 25 driven by a fan motor 25*a* (see FIG. 2). Further, the first heat source unit 20A includes various sensors. The sensors of the first heat source unit 20A will be described below. Further, the first heat 5 source unit 20A includes the first control unit 62 (see FIG. 2).

However, the first heat source unit 20A does not necessarily need to include all of the above-described components, and the configuration of the first heat source unit 20A may be designed as appropriate. For example, the first heat source unit 20A does not need to include the expansion mechanism 28 as a component and, instead of the first heat source unit 20A, the utilization unit 50 may include a similar expansion mechanism.

Furthermore, the first heat source unit 20A includes a suction pipe 16*a*, a discharge pipe 16*b*, a first gas refrigerant pipe 16*c*, a liquid refrigerant pipe 16*d*, and a second gas refrigerant pipe 16*e* (see FIG. 2).

The suction pipe 16*a* connects the flow direction switching mechanism 24 and a suction side of the compressor 22. The accumulator 34 is provided on the suction pipe 16*a* (see FIG. 2). The discharge pipe 16*b* connects a discharge side of the compressor 22 and the flow direction switching mechanism 24. The first gas refrigerant pipe 16*c* connects the flow direction switching mechanism 24 and a gas side of the heat-source heat exchanger 26. The liquid refrigerant pipe 16*d* connects a liquid side of the heat-source heat exchanger 26 and the liquid refrigerant connection pipe 12. The expansion mechanism 28 is provided in the liquid refrigerant pipe 16*d* (see FIG. 2). The first shutoff valve 30 is provided in a connection portion between the liquid refrigerant pipe 16*d* and the liquid refrigerant connection pipe 12 (see FIG. 2). The second gas refrigerant pipe 16*e* connects the flow direction switching mechanism 24 and the gas refrigerant connection pipe 14. The second shutoff valve 32 is provided in a connection portion between the second gas refrigerant pipe 16*e* and the gas refrigerant connection pipe 14 (see FIG. 2).

The primary configuration of the first heat source unit 20A will be further described below.

(2-2-1) Compressor

The compressor 22 is a device that takes in the low-pressure refrigerant in the refrigeration cycle from the suction pipe 16*a*, compresses the refrigerant with a compression mechanism, and discharges the compressed refrigerant to the discharge pipe 16*b*. According to the present embodiment, the first heat source unit 20A includes only the one compressor 22, but the number of the compressors 22 is not limited to one. For example, the first heat source unit 20A may include the plurality of compressor 22 connected in parallel. Alternatively, when the first heat source unit 20A compresses the refrigerant in multiple stages, the first heat source unit 20A may include the plurality of compressor 22 connected in series.

The type of the compressor 22 is not limited, but is for example a volume compressor 5 of a rotary type, scroll type, etc. The compression mechanism (not illustrated) of the compressor 22 is driven by a motor 22*a* (see FIG. 2). When the compression mechanism (not illustrated) is driven by the motor 22*a*, the refrigerant is compressed by the compression mechanism. The motor 22*a* is a motor whose number of revolutions may be controlled by an inverter. The capacity of the compressor 22 is controlled by controlling the number of revolutions (operating frequency) of the motor 22*a*. Alternatively, the compression mechanism of the compressor 22 may be driven by an engine (e.g., internal-combustion engine) other than the motor.

(2-2-2) Flow Direction Switching Mechanism

The flow direction switching mechanism 24 is a mechanism that switches the flow direction of the refrigerant to change the state of the heat-source heat exchanger 26 between a first state to function as a condenser and a second state to function as an evaporator. Further, when the flow direction switching mechanism 24 sets the state of the heat-source heat exchanger 26 to the first state, the utilization heat exchanger 52 functions as an evaporator. Conversely, when the flow direction switching mechanism 24 sets the state of the heat-source heat exchanger 26 to the second state, the utilization heat exchanger 52 functions as a condenser.

According to the present embodiment, the flow direction switching mechanism 24 is a four-way switching valve. However, the flow direction switching mechanism 24 is not limited to a four-way switching valve. For example, the flow direction switching mechanism 24 may include a combination of a plurality of electromagnetic valves and refrigerant pipes to enable switching of the flow direction of the refrigerant described below.

During the cooling operation, the flow direction switching mechanism 24 sets the state of the heat-source heat exchanger 26 to the first state. In other words, during the cooling operation, the flow direction switching mechanism 24 causes the suction pipe 16*a* to communicate with the second gas refrigerant pipe 16*e* and causes the discharge pipe 16*b* to communicate with the first gas refrigerant pipe 16*c* (see the solid lines in the flow direction switching mechanism 24 in FIG. 2). During the cooling operation, the refrigerant discharged from the compressor 22 flows through the refrigerant circuit 10 in order from the heat-source heat exchanger 26, the expansion mechanism 28, and then the utilization heat exchanger 52, and returns to the compressor 22.

During the heating operation, the flow direction switching mechanism 24 sets the state of the heat-source heat exchanger 26 to the second state. In other words, during the heating operation, the flow direction switching mechanism 24 causes the suction pipe 16*a* to communicate with the first gas refrigerant pipe 16*c* and causes the discharge pipe 16*b* to 5 communicate with the second gas refrigerant pipe 16*e* (see the broken lines in the flow direction switching mechanism 24 in FIG. 2). During the heating operation, the refrigerant discharged from the compressor 22 flows through the refrigerant circuit 10 in order from the utilization heat exchanger 52, the expansion mechanism 28, and then the heat-source heat exchanger 26, and returns to the compressor 22.

(2-2-3) Heat-Source Heat Exchanger

The heat-source heat exchanger 26 executes heat exchange between the refrigerant flowing inside and the air in the installation place of the first heat source unit 20A. Here, the outside air refers to the air that is outside the casing 21 of the first heat source unit 20A and serves as a heat source for the first air-conditioning apparatus 1A.

The type of the heat-source heat exchanger 26 is not limited, but is for example a fin-and-tube type heat exchanger including a plurality of heat transfer tubes and fins (not illustrated).

One end of the heat-source heat exchanger 26 is connected to the liquid refrigerant pipe 16*d*. The other end of the heat-source heat exchanger 26 is connected to the first gas refrigerant pipe 16*c*.

The heat-source heat exchanger 26 functions as a condenser (radiator) during the cooling operation and functions as an evaporator during the heating operation.

(2-2-4) Expansion Mechanism

The expansion mechanism 28 is provided in the liquid refrigerant pipe 16*d* between the heat-source heat exchanger 26 and the first shutoff valve 30 (see FIG. 2). Further, when the utilization unit 50 includes an expansion mechanism similar to the expansion mechanism 28 instead of the first heat source unit 20A including the expansion mechanism 28, the expansion mechanism may be provided in the refrigerant pipe connecting the liquid refrigerant connection pipe 12 and the utilization heat exchanger 52 inside the utilization unit 50.

The expansion mechanism 28 adjusts the pressure and the flow rate of the refrigerant flowing through the liquid refrigerant pipe 16*d*. According to the present embodiment, the expansion mechanism 28 is an electronic expansion valve having a variable opening degree. However, the expansion mechanism 28 is not limited to an electronic expansion valve. For example, the expansion mechanism 28 may be a temperature-sensitive cylinder type expansion valve or capillary tube.

(2-2-5) Accumulator

The accumulator 34 has a gas-liquid separation function to separate the flowing refrigerant into a gas refrigerant and a liquid refrigerant. Furthermore, the accumulator 34 is a container having a function to store an excess refrigerant generated in accordance with fluctuations in the operation load of the utilization unit 50, etc. The accumulator 34 is provided in the suction pipe 16*a* (see FIG. 2). The refrigerant flowing into the accumulator 34 is separated into a gas refrigerant and a liquid refrigerant, and the gas refrigerant collected in an upper space flows into the compressor 22.

(2-2-6) Liquid-Side Shutoff Valve and Gas-Side Shutoff Valve

The first shutoff valve 30 is a valve provided in a connection portion between the liquid refrigerant pipe 16*d* and the liquid refrigerant connection pipe 12. The second shutoff valve 32 is a valve provided in a connection portion between the second gas refrigerant pipe 16*e* and the gas refrigerant connection pipe 14. The first shutoff valve 30 and the second shutoff valve 32 are, for example, manually operated valves.

(2-2-7) First Fan

The first fan 25 is a fan that suctions the heat source air (outside air) outside the casing 21 of the first heat source unit 20A into the casing 21, supplies the heat source air to the heat-source heat exchanger 26, and exhausts the air having exchanged heat with the refrigerant in the heat-source heat exchanger 26 to the outside of the casing 21 of the first heat source unit 20A.

The first fan 25 is, for example, a propeller fan. However, the fan type of the first fan 25 is not limited to a propeller fan and may be selected as appropriate.

The first fan 25 is a variable air-volume fan driven by the fan motor 25*a* (see FIG. 2) capable of changing the number of revolutions.

(2-2-8) Sensor

Various sensors are provided in the first heat source unit 20A. For example, the first heat source unit 20A includes temperature sensors and pressure sensors below. Types of temperature sensors and pressure sensors may be selected as appropriate.

The sensors included in the first heat source unit 20A include a suction temperature sensor 41, a suction pressure sensor 42, a discharge temperature sensor 43, a discharge pressure sensor 44, a heat exchange temperature sensor 45, a third temperature sensor 46, and an inlet air temperature sensor 47 (see FIG. 2). Further, the first heat source unit 20A may include only some of the sensors 41 to 47. Moreover, the first heat source unit 20A may include a sensor other than the sensors 41 to 47 described above.

The suction temperature sensor 41 is provided in the suction pipe 16*a* (see FIG. 2). The suction temperature sensor 41 is a sensor that measures a suction temperature Ts.

The suction pressure sensor 42 is provided in the suction pipe 16*a* (see FIG. 2). The 5 suction pressure sensor 42 is a sensor that measures a suction pressure Ps.

The discharge temperature sensor 43 is provided in the discharge pipe 16*b* (see FIG. 2). The discharge temperature sensor 43 is a sensor that measures a discharge temperature Td.

The discharge pressure sensor 44 is provided in the discharge pipe 16*b* (see FIG. 2). The discharge pressure sensor 44 is a sensor that measures a discharge pressure Pd.

The heat exchange temperature sensor 45 is provided in the heat-source heat exchanger 26 (see FIG. 2). The heat exchange temperature sensor 45 measures the temperature of the refrigerant flowing through the heat-source heat exchanger 26. The heat exchange temperature sensor 45 measures a refrigerant temperature corresponding to a condensation temperature Tc during the cooling operation and measures a refrigerant temperature corresponding to an evaporation temperature Te during the heating operation.

The third temperature sensor 46 is provided in the liquid refrigerant pipe 16*d* (the liquid side of the heat-source heat exchanger 26) to measure a temperature Tb of the refrigerant flowing through the liquid refrigerant pipe 16*d*.

The inlet air temperature sensor 47 measures a temperature T1 of the air flowing into the casing 21 before exchanging heat with the refrigerant in the heat-source heat exchanger 26. The inlet air temperature sensor 47 is provided, for example, near an intake port (not illustrated) of the casing 21.

(2-2-9) First Control Unit

The first control unit 62 controls the operation of each unit included in the first heat source unit 20A.

The first control unit 62 includes a microcomputer provided to control the first heat source unit 20A, a memory that stores a control program executable by the microcomputer, etc. Furthermore, the configuration of the first control unit 62 described here is merely an example, and, for example, the function of the first control unit 62 described below may be implemented by software, hardware, or a combination of software and hardware.

The first control unit 62 is electrically connected to the compressor 22, the flow direction switching mechanism 24, the expansion mechanism 28, the first fan 25, the suction temperature sensor 41, the suction pressure sensor 42, the discharge temperature sensor 43, the discharge pressure sensor 44, the heat exchange temperature sensor 45, the third temperature sensor 46, and the inlet air temperature sensor 47 to enable an exchange of control signals and information (see FIG. 2).

The first control unit 62 is connected to the second control unit 64 of the utilization unit 50 via the transmission line 66 to enable an exchange of control signals, etc. The first control unit 62 and the second control unit 64 cooperate with each other to function as the control unit 60A that controls the operation of the entire first air-conditioning apparatus 1A. The control unit 60A will be described below.

(2-3) Refrigerant Connection Pipe

The first air-conditioning apparatus 1A includes the liquid refrigerant connection pipe 12 and the gas refrigerant connection pipe 14 as refrigerant connection pipes. The liquid refrigerant connection pipe 12 and the gas refrigerant connection pipe 14 are pipes that are installed at an installation site of the first air-conditioning apparatus 1A when the first air-conditioning apparatus 1A is installed. As the liquid refrigerant connection pipe 12 and the gas refrigerant connection pipe 14, pipes having various lengths and diameters are used in accordance with installation conditions such as the installation place and the combination of the first heat source unit 20A and the utilization unit 50.

The utilization unit 50 and the first heat source unit 20A are connected with the liquid refrigerant connection pipe 12 and the gas refrigerant connection pipe 14 so that the refrigerant circuit 10 of the first air-conditioning apparatus 1A is formed.

(2-4) Control Unit

The first control unit 62 of the first heat source unit 20A and the second control unit 64 of the utilization unit 50 are communicatively connected to each other via the transmission line 66 so that the control unit 60A is formed. The microcomputers of the first control unit 62 and the second control unit 64 execute programs stored in the memories, and thus the control unit 60A controls the operation of the entire first air-conditioning apparatus 1A.

Furthermore, according to the present embodiment, the first control unit 62 and the second control unit 64 constitute the control unit 60A, but the configuration of the control unit 60A is not limited to this form. For example, in addition to the first control unit 62 and the second control unit 64 or instead of the first control unit 62 and the second control unit 64, the first air-conditioning apparatus 1A may include a control device that performs part or all of the functions of the control unit 60A described below. For example, the control device may be a device dedicated to the control of the first air-conditioning apparatus 1A or may be a device that controls a plurality of air-conditioning apparatuses (e.g., the second air-conditioning apparatus 1B) including the first air-conditioning apparatus 1A. The control device may be a server installed at a place different from the place where the first air-conditioning apparatus 1A and the second air-conditioning apparatus 1B are installed.

As indicated in broken lines in FIG. 2, the control unit 60A is electrically connected to various devices in the first heat source unit 20A and the utilization unit 50. The various devices 5 in the first heat source unit 20A and the utilization unit 50 include the compressor 22, the flow direction switching mechanism 24, the expansion mechanism 28, the first fan 25, and the second fan 54. Furthermore, as illustrated in FIG. 2, the control unit 60A is electrically connected to the various sensors 41 to 47 provided in the first heat source unit 20A and the various sensors 55 to 57 provided in the utilization unit 50.

The control unit 60A controls the operation and stoppage of the first air-conditioning apparatus 1A and the operations of the various devices 22, 24, 25, 28, 54, and the like, of the first air-conditioning apparatus 1A based on the measurement signals of the various sensors 41 to 47 and 55 to 57, commands received by the second control unit 64 from a remote controller (not illustrated), etc. Furthermore, the control unit 60A controls the operation and stoppage of the first air-conditioning apparatus 1A and the operations of the various devices 22, 24, 25, 28, 54, and the like, of the first air-conditioning apparatus 1A based on instructions from the refrigerant circuit apparatus evaluation system 100.

(2-5) Operation of First Air-Conditioning Apparatus

The control on the operations of the first air-conditioning apparatus 1A during the cooling operation and the heating operation will be described.

(2-5-1) Operation During Cooling Operation

When an instruction is given to the first air-conditioning apparatus 1A to perform the cooling operation, the control unit 60A sets the operating mode of the first air-conditioning apparatus 1A to a cooling operating mode. Specifically, the control unit 60A controls the flow direction switching mechanism 24 in the state indicated in the solid line in FIG. 2 such that the state of the heat-source heat exchanger 26 becomes the first state to function as a condenser, and operates the compressor 22, the first fan 25, and the second fan 54.

During the cooling operation, the control unit 60A controls the devices of the first air-conditioning apparatus 1A as described below, for example. Further, the control on the operation of the first air-conditioning apparatus 1A during the cooling operation described here is an example, and the method for controlling the first air-conditioning apparatus 1A during the cooling operation by the control unit 60A is not limited. For example, the control unit 60A may control the operations of various devices based on a parameter other than those described here.

The control unit 60A controls the number of revolutions of the fan motor 25*a* that drives the first fan 25 and the number of revolutions of the fan motor 54*a* that drives the second fan 54 to be predetermined numbers of revolutions. For example, the control unit 60A controls the number of revolutions of the fan motor 25*a* to be the maximum number of revolutions. The control unit 60A appropriately controls the number of revolutions of the fan motor 54*a* based on the instruction for the air volume input to the remote controller, etc.

The control unit 60A adjusts the opening degree of the electronic expansion valve, which is an example of the expansion mechanism 28, such that a degree of subcooling SCr of the refrigerant at a liquid-side outlet of the heat-source heat exchanger 26 becomes a predetermined target degree of subcooling SCrs. The degree of subcooling SCr of the refrigerant at the liquid-side outlet of the heat-source heat exchanger 26 is calculated, for example, by subtracting the measurement value (the temperature Tb) of the third temperature sensor 46 from the condensation temperature Tc measured by the heat exchange temperature sensor 45. For example, the degree of subcooling SCr may be calculated based on the measurement value of another sensor.

The control unit 60A controls the operating capacity of the compressor 22 such that the evaporation temperature Te corresponding to the measurement value (the suction pressure Ps) of the suction pressure sensor 42 approaches a target evaporation temperature Tes determined by the temperature difference between the space temperature Tr measured by the space temperature sensor 57 and the set temperature Trs. The control on the operating capacity of the compressor 22 is controlled by controlling the number of revolutions of the motor 22*a*.

During the cooling operation, when the operations of the devices in the first air-conditioning apparatus 1A are controlled as described above, the refrigerant flows through the refrigerant circuit 10 as described below.

When the compressor 22 is activated, a low-pressure gas refrigerant in the refrigeration cycle is suctioned into the compressor 22 and compressed by the compressor 22 to become a high-pressure gas refrigerant in the refrigeration cycle. The high-pressure gas refrigerant is delivered to the heat-source heat exchanger 26 via the flow direction switching mechanism 24 and exchanges heat with the outside air supplied by the first fan 25 to condense and become a high-pressure liquid refrigerant. The air having exchanged heat with the refrigerant in the heat-source heat exchanger 26 (the air heated by the refrigerant) is exhausted through an exhaust port (not illustrated) of the casing 21 of the first heat source unit 20A. The high-pressure liquid refrigerant flows through the liquid refrigerant pipe 16*d*, reduces its pressure up to approximately the suction pressure of the compressor 22 in the expansion mechanism 28 to become a refrigerant in a gas-liquid two-phase state, and is delivered to the utilization unit 50. In the utilization heat exchanger 52, the refrigerant in the gas-liquid two-phase state delivered to the utilization unit 50 exchanges heat with the air in the air-conditioning target space supplied to the utilization heat exchanger 52 by the second fan 54 to evaporate and become a low-pressure gas refrigerant. The low-pressure gas refrigerant is delivered to the first heat source 5 unit 20A via the gas refrigerant connection pipe 14 and flows into the accumulator 34 via the flow direction switching mechanism 24. The low-pressure gas refrigerant flowing into the accumulator 34 is again suctioned into the compressor 22. Furthermore, the temperature of the air supplied to the utilization heat exchanger 52 is lowered due to heat exchange with the refrigerant flowing through the utilization heat exchanger 52, and the air cooled in the utilization heat exchanger 52 is blown out to the air-conditioning target space.

(2-5-2) Operation During Heating Operation

When an instruction is given to the first air-conditioning apparatus 1A to perform the heating operation, the control unit 60A sets the operating mode of the first air-conditioning apparatus 1A to the heating operating mode. Specifically, the control unit 60A controls the flow direction switching mechanism 24 in the state indicated in the broken line in FIG. 2 such that the state of the heat-source heat exchanger 26 becomes the second state to function as an evaporator, and operates the compressor 22, the first fan 25, and the second fan 54.

During the heating operation, the control unit 60A controls the devices of the first air-conditioning apparatus 1A as described below, for example. Furthermore, the control on the operation of the first air-conditioning apparatus 1A during the heating operation described here is an example, and the method for controlling the first air-conditioning apparatus 1A during the heating operation by the control unit 60A is not limited. For example, the control unit 60A may control the operations of various devices based on a parameter other than those described here.

The control unit 60A controls the number of revolutions of the fan motor 25*a* that drives the first fan 25 and the number of revolutions of the fan motor 54*a* that drives the second fan 54 to be predetermined numbers of revolutions. For example, the control unit 60A controls the number of revolutions of the fan motor 25*a* to be the maximum number of revolutions. The control unit 60A appropriately controls the number of revolutions of the fan motor 54*a* based on the instruction for the air volume input to the remote controller, etc.

The control unit 60A adjusts the opening degree of the electronic expansion valve, which is an example of the expansion mechanism 28, such that the degree of subcooling SCr of the refrigerant at a liquid-side outlet of the utilization heat exchanger 52 becomes the predetermined target degree of subcooling SCrs. The degree of subcooling SCr of the refrigerant at the liquid-side outlet of the utilization heat exchanger 52 is calculated, for example, by subtracting the measurement value of the second temperature sensor 56 from the condensation temperature Tc converted from the measurement value (the discharge pressure Pd) of the discharge pressure sensor 44.

The control unit 60A controls the operating capacity of the compressor 22 such that the condensation temperature Tc corresponding to the measurement value (the discharge pressure Pd) of the discharge pressure sensor 44 approaches a target condensation temperature Tcs determined by the temperature difference between the space temperature Tr measured by the space temperature sensor 57 and the set temperature Trs. The operating capacity of the compressor 22 is controlled by controlling the number of revolutions of the motor 22*a*.

During the heating operation, when the operations of the devices in the first air-conditioning apparatus 1A are controlled as described above, the refrigerant flows through the refrigerant circuit 10 as described below.

When the compressor 22 is activated, a low-pressure gas refrigerant in the refrigeration cycle is suctioned into the compressor 22 and compressed by the compressor 22 to become a high-pressure gas refrigerant in the refrigeration cycle. The high-pressure gas refrigerant is delivered to the utilization heat exchanger 52 via the flow direction switching mechanism 24 and exchanges heat with the air in the air-conditioning target space supplied by the second fan 54 to condense and become a high-pressure liquid refrigerant. The temperature of the air supplied to the utilization heat exchanger 52 is increased due to heat exchange with the refrigerant flowing through the utilization heat exchanger 52, and the air heated by the utilization heat exchanger 52 is blown out to the air-conditioning target space. The high-pressure liquid refrigerant flowing out of the utilization heat exchanger 52 is delivered to the first heat source unit 20A via the liquid refrigerant connection pipe 12 and flows into the liquid refrigerant pipe 16*d*. The refrigerant flowing through the liquid refrigerant pipe 16*d* reduces its pressure up to approximately the suction pressure of the compressor 22 when passing through the expansion mechanism 28, becomes a refrigerant in a gas-liquid two-phase state, and flows into the heat-source heat exchanger 26. The low-pressure refrigerant in a gas-liquid two-phase state that has flown into the heat-source heat exchanger 26 exchanges heat with the heat source air supplied by the first fan 25 to evaporate and become a low-pressure gas refrigerant, and flows into the accumulator 34 via the flow direction switching mechanism 24. The low-pressure gas refrigerant flowing into the accumulator 34 is again suctioned into the compressor 22. Furthermore, the air having exchanged heat with the refrigerant in the heat-source heat exchanger 26 (the air cooled by the refrigerant) is exhausted through the exhaust port (not illustrated) of the casing 21 of the first heat source unit 20A.

(3) Refrigerant Circuit Apparatus Evaluation System

The refrigerant circuit apparatus evaluation system 100 will be described with reference to FIG. 3. Here, the refrigerant circuit apparatus evaluation system 100 will be described by using, as an example, the case where the refrigerant circuit apparatus evaluation system 100 determines whether the operation of the second heat source unit 20B has an adverse effect on the operation of the first heat source unit 20A. Furthermore, in order to avoid redundant description below, the process of the refrigerant circuit apparatus evaluation system 100 to determine whether the operation of the second heat source unit 20B has an adverse effect on the operation of the first heat source unit 20A of the first air-conditioning apparatus 1A may be referred to as "evaluation process".

The evaluation process by the refrigerant circuit apparatus evaluation system 100 is performed, for example, when at least either one of the first air-conditioning apparatus 1A and the second air-conditioning apparatus 1B is installed. Furthermore, the evaluation process by the refrigerant circuit apparatus evaluation system 100 is performed, for example, when the position of at least either one of the first heat source unit 20A and the second heat source unit 20B is changed for some reason.

The refrigerant circuit apparatus evaluation system 100 primarily includes the evaluation apparatus 110. According to the present embodiment, the evaluation apparatus 110 is a computer. The evaluation apparatus 110 may be a single computer or may include a plurality of computers communicatively connected to each other.

According to the present embodiment, the evaluation apparatus 110 is a computer (an independent device separately installed from the first air-conditioning apparatus 1A and the second air-conditioning apparatus 1B) as a central management device installed in a building or facility where the first air-conditioning apparatus 1A and the second air-conditioning apparatus 1B are installed. However, this is not a limitation, and the evaluation apparatus 110 may be mounted on, for example, the first air-conditioning apparatus 1A or the second air-conditioning apparatus 1B. Further, for example, the evaluation apparatus 110 may be a server installed at a place different from the first air-conditioning apparatus 1A and the second air-conditioning apparatus 1B. Further, for example, the evaluation apparatus 110 may be a computer carried by the installation worker of the first air-conditioning apparatus 1A and the second air-conditioning apparatus 1B.

Further, the configuration of the evaluation apparatus 110 described here is merely an example, and the function of the evaluation apparatus 110 described below may be implemented by software, hardware, or a combination of software and hardware.

Figure 3:
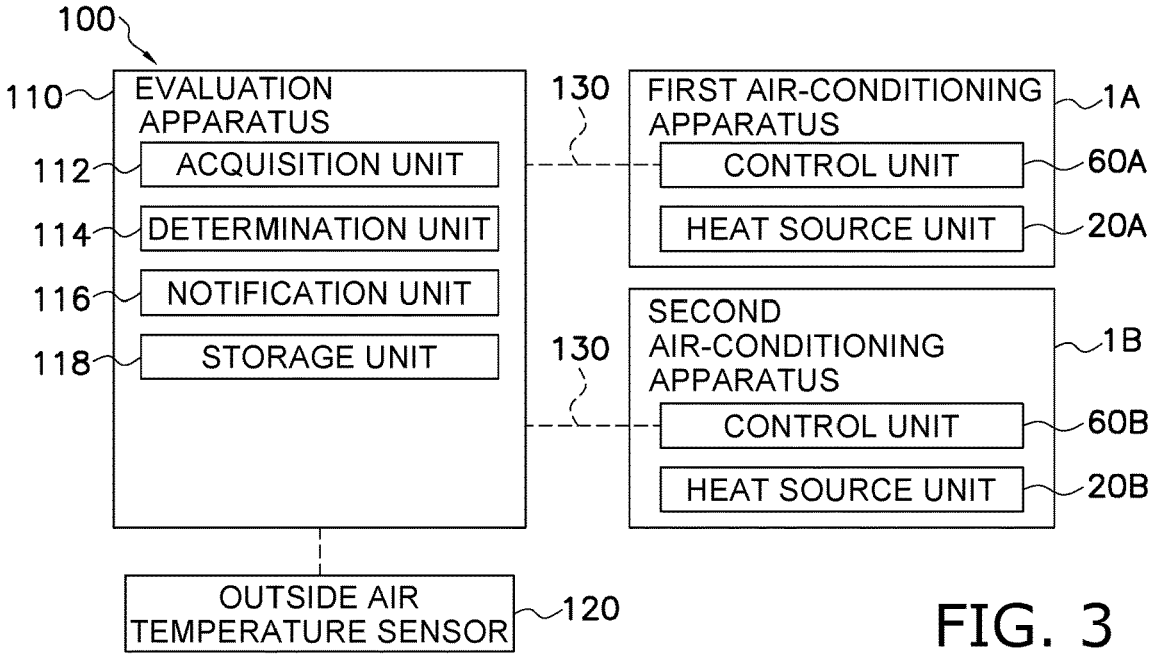
FIG. 3 is a block diagram of the refrigerant circuit apparatus evaluation system in FIG. 1, the first air-conditioning apparatus, and the second air-conditioning apparatus.

The evaluation apparatus 110 is communicatively connected to the control unit 60A of the first air-conditioning apparatus 1A via a network 130 such as the Internet (see FIG. 3). Further, for example, the evaluation apparatus 110 may be communicatively connected to the control unit 60B of the second air-conditioning apparatus 1B via the network 130 (see FIG. 3). Alternatively, the evaluation apparatus 110 and the control units 60A and 60B may be communicatively connected to each other via a physical communication line.

The evaluation apparatus 110 may receive the operation data on the first air-conditioning apparatus 1A from the control unit 60A. The operation data on the first air-conditioning apparatus 1A received by the evaluation apparatus 110 includes, for example, the data on the operating states of various devices of the first air-conditioning apparatus 1A and the data on the temperature of the air, which affect the operation of the first air-conditioning apparatus 1A. Furthermore, the operation data on the first air-conditioning apparatus 1A includes, for example, the data on the temperature and pressure of the refrigerant that change depending on the operating state of the first air-conditioning apparatus 1A.

Specifically, the operation data on the first air-conditioning apparatus 1A includes, for example, the numbers of revolutions of the motors 22*a*, 25*a*, and 54*a*, the opening degree of the electronic expansion valve serving as the expansion mechanism 28, the measurement values of the various sensors 41 to 47 and 55 to 57 of the first air-conditioning apparatus 1A, etc. Further, the types of the data on the operating states of various devices in the air-conditioning apparatus 1A are not limited to those described here. Further, the operation data on the first air-conditioning apparatus 1A received by the evaluation apparatus 110 do not need to include the data unnecessary for the evaluation process of the refrigerant circuit apparatus evaluation system 100 described below.

Further, for example, the evaluation apparatus 110 may also receive the operation data on the second air-conditioning apparatus 1B from the control unit 60B. As the operation data on the second air-conditioning apparatus 1B is similar to the operation data on the first air-conditioning apparatus 1A, the description thereof is omitted here.

Further, the evaluation apparatus 110 may be configured to be able to transmit an operation command to the control units 60A and 60B of the air-conditioning apparatuses 1A and 1B via the network 130, or the like.

The evaluation apparatus 110 primarily functions as an acquisition unit 112, a determination unit 114, and a notification unit 116 regarding the evaluation process when the CPU of the computer executes a program stored in the memory (see FIG. 3). Further, the evaluation apparatus 110 includes a storage unit 118 that stores information regarding the evaluation process. Furthermore, when the evaluation apparatus 110 includes a plurality of devices, the acquisition unit 112, the determination unit 114, the notification unit 116, and the storage unit 118, which are functional units, do not need to be implemented by one device and may be implemented by the plurality of devices.

(3-1) Acquisition Unit

The acquisition unit 112 acquires the operation data on the first air-conditioning apparatus 1A described above from the control unit 60A communicatively connected to the evaluation apparatus 110. The type of operation data acquired by the acquisition unit 112 for the evaluation process by the evaluation apparatus 110 will be described below together with the description of the evaluation process.

Further, when the refrigerant circuit apparatus evaluation system 100 determines whether the operation of the first heat source unit 20A has an adverse effect on the operation of the second heat source unit 20B, the acquisition unit 112 acquires the operation data on the second air-conditioning apparatus 1B from the control unit 60B communicatively connected to the evaluation apparatus 110.

Further, the acquisition unit 112 may acquire an outside air temperature To from an outside air temperature sensor 120. The outside air temperature sensor 120 is a sensor that measures the outside air temperature To. For example, the outside air temperature sensor 120 is installed around the installation place of the heat source units 20A and 20B. The outside air temperature sensor 120 is communicatively connected to the evaluation apparatus 110.

The outside air temperature sensor 120 is, for example, a temperature sensor installed independently of the first air-conditioning apparatus 1A and the second air-conditioning apparatus 1B. However, this is not a limitation and, for example, the outside air temperature sensor 120 may be a sensor included in the first air-conditioning apparatus 1A and the second air-conditioning apparatus 1B. In this case, the acquisition unit 112 may acquire the outside air temperature To from the control units 60A and 60B communicatively connected to the evaluation apparatus 110.

(3-2) Determination Unit

The determination unit 114 determines whether the operation of the second heat source unit 20B has an adverse effect on the operation of the first heat source unit 20A based on the operation data on the first air-conditioning apparatus 1A acquired by the acquisition unit 112 when the first air-conditioning apparatus 1A and the second air-conditioning apparatus 1B are simultaneously operating. A determination method of the determination unit 114 will be described below.

(3-3) Notification Unit

The notification unit 116 notifies that the operation of the second heat source unit 20B has an adverse effect on the operation of the first heat source unit 20A when the determination unit 114 determines that the operation of the second heat source unit 20B has an adverse effect 5 on the operation of the first heat source unit 20A.

For example, the notification unit 116 presents on a display (not illustrated) of the evaluation apparatus 110 with characters, or the like, that the operation of the second heat source unit 20B has an adverse effect on the operation of the first heat source unit 20A. Alternatively, the notification unit 116 may turn on a lamp (not illustrated) or output an alarming sound from a speaker (not illustrated) to notify that the operation of the second heat source unit 20B has an adverse effect on the operation of the first heat source unit 20A. Alternatively, the notification unit 116 may transmit, via a network such as the Internet, a message notifying that the operation of the second heat source unit 20B has an adverse effect on the operation of the first heat source unit 20A to a mobile terminal (not illustrated) owned by the installation worker of the first air-conditioning apparatus 1A and the second air-conditioning apparatus 1B.

(3-4) Storage Unit

The storage unit 118 stores various types of information necessary for the evaluation process by the refrigerant circuit apparatus evaluation system 100. For example, the storage unit 118 acquires various types of information acquired by the acquisition unit 112. A specific example of the information stored in the storage unit 118 will be described below.

(4) Evaluation Process by Refrigerant Circuit Apparatus Evaluation System

Figure 4:
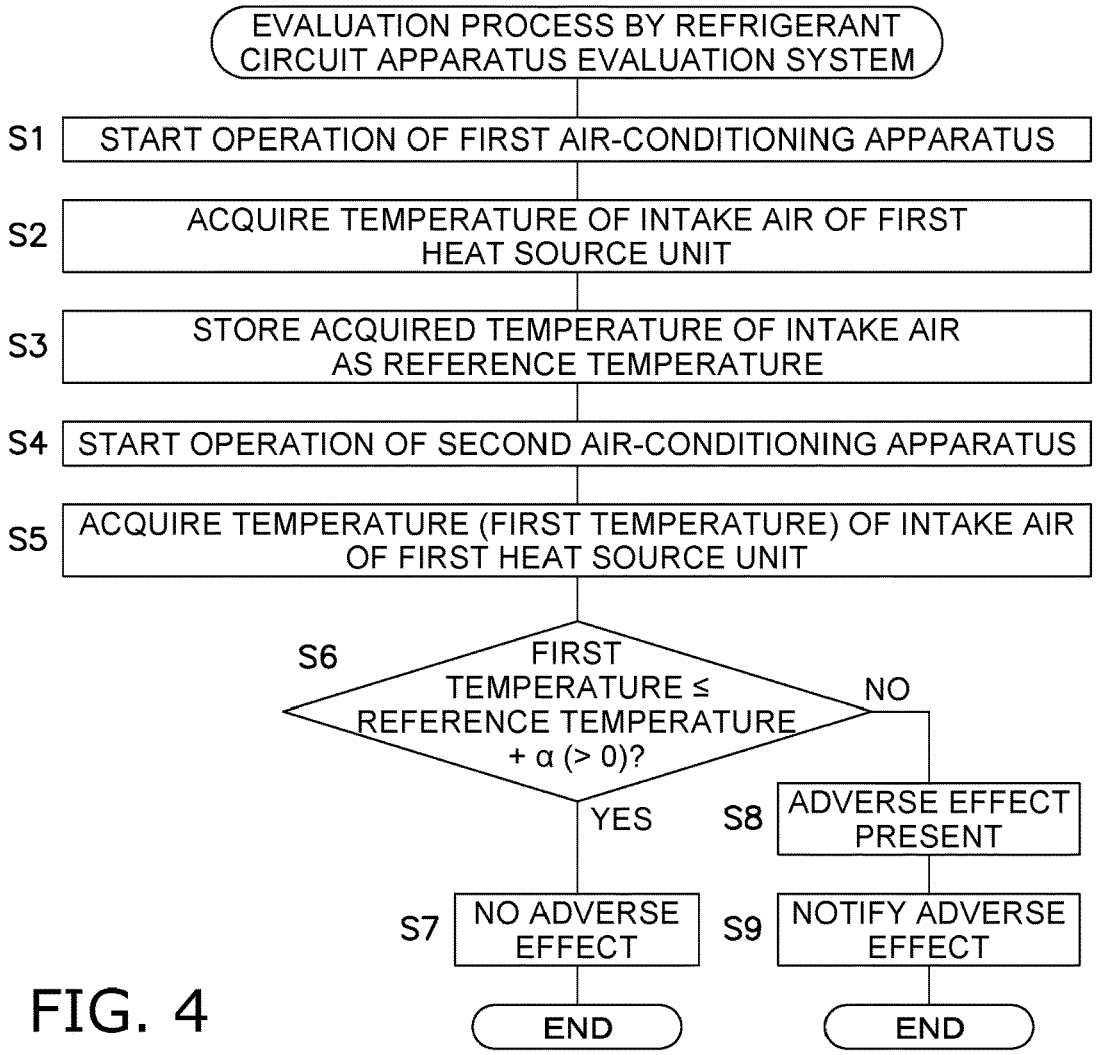
FIG. 4 is a flowchart of an evaluation process according to a first example by the refrigerant circuit apparatus evaluation system in FIG. 3.
Figure 5:
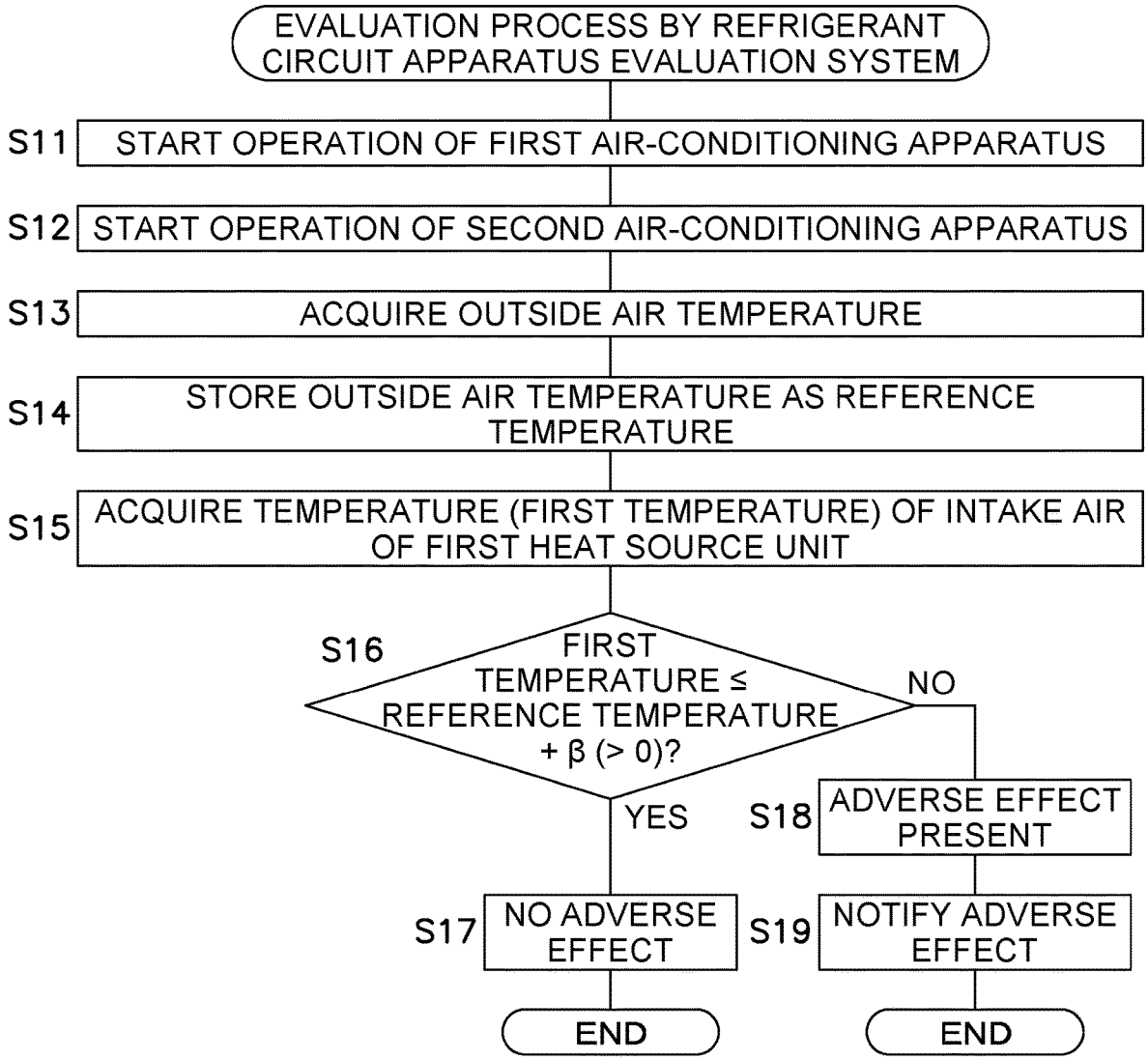
FIG. 5 is a flowchart of an evaluation process according to a second example by the refrigerant circuit apparatus evaluation system in FIG. 3.
Figure 6:
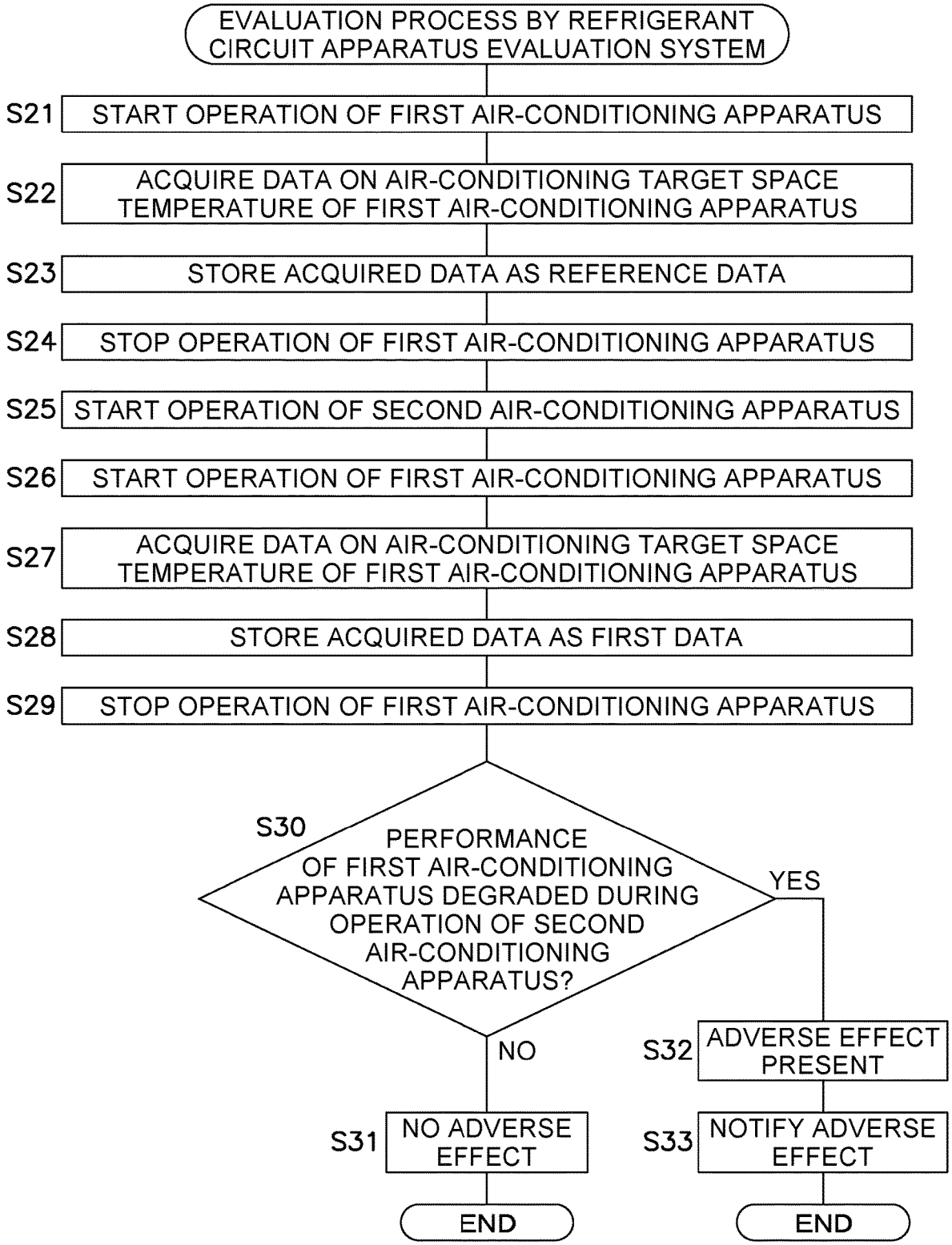
FIG. 6 is a flowchart of an evaluation process according to a third example by the refrigerant circuit apparatus evaluation system in FIG. 3.

Examples of the evaluation process by the refrigerant circuit apparatus evaluation system 100 will be described with reference to FIG. 4 to FIG. 6. FIG. 4 is a flowchart of an example (first example) of the evaluation process performed by the refrigerant circuit apparatus evaluation system 100. FIG. 5 is a flowchart of another example (second example) of the evaluation process performed by the refrigerant circuit apparatus evaluation system 100. FIG. 6 is a flowchart of further another example (third example) of the evaluation process performed by the refrigerant circuit apparatus evaluation system 100.

(4-1) First Example

The first example of the evaluation process by the refrigerant circuit apparatus evaluation system 100 will be described with reference to FIG. 4. Furthermore, the flow of the evaluation process described here is merely an example. Further, the content of the evaluation process according to the first example may be changed as appropriate.

Moreover, as described here, the first air-conditioning apparatus 1A and the second air-conditioning apparatus 1B are operated during the evaluation process by the refrigerant circuit apparatus evaluation system 100. In order to automate the evaluation process, for example, the evaluation apparatus 110 that performs the evaluation process may transmit operation commands to the first air-conditioning apparatus 1A and the second air-conditioning apparatus 1B via the network 130. However, this is not a limitation, and the operation commands for the first air-conditioning apparatus 1A and the second air-conditioning apparatus 1B may be transmitted from remote controllers (not illustrated) of the first air-conditioning apparatus 1A and the second air-conditioning apparatus 1B operated by the worker, or the like, who uses the refrigerant circuit apparatus evaluation system 100. In other words, during the evaluation process by the refrigerant circuit apparatus evaluation system 100, a person may give an instruction for the start of operation of the first air-conditioning apparatus 1A and the second air-conditioning apparatus 1B.

In order to perform the evaluation process, first, the operation of the first air-conditioning apparatus 1A is started while the second air-conditioning apparatus 1B is stopped (Step S1). The operation of the first air-conditioning apparatus 1A may be a cooling operation or heating operation. Here, it is assumed that the first air-conditioning apparatus 1A performs the cooling operation in the same manner as the second air-conditioning apparatus 1B described below.

Subsequently, the acquisition unit 112 of the evaluation apparatus 110 acquires the measurement value of the inlet air temperature sensor 47 transmitted from the control unit 60A of the first air-conditioning apparatus 1A, i.e., the temperature of the intake air taken into the first heat source unit 20A (Step S2). In short, at Step S2, the acquisition unit 112 acquires the operation data on the first air-conditioning apparatus 1A when the second air-conditioning apparatus 1B stops its operation and the first air-conditioning apparatus 1A is operating. Then, the evaluation apparatus 110 stores the temperature of the intake air acquired by the acquisition unit 112 as a reference temperature in the storage unit 118 (Step S3). Furthermore, for example, the reference temperature may be data on the temperature T1 of the intake air measured by the inlet air temperature sensor 47 at a certain moment. Alternatively, the reference temperature may be a mean value, an intermediate value, or the like, of the temperatures T1 of the intake air measured by the inlet air temperature sensor 47 at multiple time points.

Subsequently, at Step S4, the operation of the second air-conditioning apparatus 1B is started while the operation of the first air-conditioning apparatus 1A is continued.

Furthermore, in the flowchart of FIG. 4, the first air-conditioning apparatus 1A is continuously operated after Step S1, but this is not a limitation. In the determination process of the refrigerant circuit apparatus evaluation system 100, for example, the operation of the first air-conditioning apparatus 1A may be temporarily stopped before the operation of the second air-conditioning apparatus 1B is started and the operation of the first air-conditioning apparatus 1A may be restarted after the operation of the second air-conditioning apparatus 1B is started. The operation of the second air-conditioning apparatus 1B may be a cooling operation or heating operation. Further, FIG. 4 is a flowchart of the evaluation process when the operation of the second air-conditioning apparatus 1B is the cooling operation. Here, the case where the operation of the second air-conditioning apparatus 1B is the cooling operation will be described as an example according to the flowchart of FIG. 4.

At Step S5, the acquisition unit 112 of the evaluation apparatus 110 acquires the measurement value of the inlet air temperature sensor 47 transmitted from the control unit 60A of the first air-conditioning apparatus 1A, i.e., the data on the temperature of the intake air taken into the first heat source unit 20A (Step S5). In short, at Step S5, the acquisition unit 112 acquires the operation data on the first air-conditioning apparatus 1A when the first air-conditioning apparatus 1A and the second air-conditioning apparatus 1B are simultaneously operating. Preferably, at Step S5, the acquisition unit 112 acquires the temperature of the intake air taken into the first heat source unit 20A after the second air-conditioning apparatus 1B ends the start-up control and the operation of the second air-conditioning apparatus 1B shifts to a steady operation. Here, the temperature of the intake air acquired by the acquisition unit 112 at Step S5 is referred to as a first temperature.

The first temperature may be the data on the temperature T1 of the intake air measured by the inlet air temperature sensor 47 at a certain moment. Alternatively, the first temperature may be a mean value, an intermediate value, or the like, of the temperatures T1 of the intake air measured by the inlet air temperature sensor 47 at multiple time points.

Subsequently, the determination unit 114 compares the first temperature with the reference temperature stored in the storage unit 118 (Step S6).

Then, in a case where the condition of the first temperature≤(the reference temperature+$\alpha$ ($\alpha$>0)) is satisfied, the determination unit 114 determines that the operation of the second heat source unit 20B does not adversely affect the operation of the first heat source unit 20A of the first air-conditioning apparatus 1A (Step S7). Conversely, when the condition of the first temperature≤(the reference temperature+$\alpha$) is not satisfied (in other words, when the first temperature>(the reference temperature+$\alpha$)), the determination unit 114 determines that the operation of the second heat source unit 20B adversely affects the operation of the first heat source unit 20A of the first air-conditioning apparatus 1A (Step S8).

The reason why the determination unit 114 performs such a process will be described in detail.

During the cooling operation, the second heat source unit 20B of the second air-conditioning apparatus 1B exhausts the air heated by the refrigerant in the heat-source heat exchanger 26 to the outside of the casing 21. Therefore, when the installation position of either the first heat source unit 20A or the second heat source unit 20B is not appropriate and the exhaust air of the second heat source unit 20B is taken into the first heat source unit 20A as intake air, the temperature of the intake air of the first heat source unit 20A becomes higher than the reference temperature (in short, the temperature of the intake air of the first heat source unit 20A while the second heat source unit 20B is stopped). Therefore, by comparing the first temperature with the reference temperature, it is possible to determine whether the exhaust air of the second heat source unit 20B is taken into the first heat source unit 20A as intake air or not. Further, as an increase in the temperature of the air taken into the first heat source unit 20A during the cooling operation causes an increase in the temperature of the heat source air for cooling the refrigerant, the operation of the first heat source unit 20A is adversely affected by the operation of the second heat source unit 20B, which results in a decrease in the operation efficiency of the first air-conditioning apparatus 1A.

Furthermore, here, one reason why the first temperature is compared with (the reference temperature+α (α>0)) instead of the reference temperature is to prevent the occurrence of the situation where the determination unit 114 determines that a measurement error of the inlet air temperature sensor 47 or a change in the outside air temperature as a situation where the operation of the second heat source unit 20B adversely affects the operation of the first heat source unit 20A. Furthermore, another reason is that, even when the exhaust air of the heat source unit 20B is taken into the heat source unit 20A as intake air, a small increase in the temperature of the inlet air substantially has no adverse effect on the operating performance of the first air-conditioning apparatus 1A. The value of a may be determined as appropriate.

Furthermore, here, the case where the second air-conditioning apparatus 1B performs the cooling operation is described as an example, but in a case where the second air-conditioning apparatus 1B performs the heating operation, the determination unit 114 determines that the operation of the second heat source unit 20B does not adversely affect the operation of the first heat source unit 20A when the condition of the first temperature≥(the reference temperature−α2 (α2>0)) is satisfied. Conversely, when the condition of the first temperature≥(the reference temperature−α2) is not satisfied (in other words, when the first temperature<(the reference temperature−α2)), the determination unit 114 determines that the operation of the second heat source unit 20B adversely affects the operation of the first heat source unit 20A. Detailed description will be omitted.

When the determination unit 114 determines that the operation of the second heat source unit 20B does not adversely affect the operation of the first heat source unit 20A as a result of the comparison between the first temperature and the reference temperature (Step S7), the evaluation process of the refrigerant circuit apparatus evaluation system 100 ends. Further, although not illustrated, when the process proceeds to Step S7, for example, the notification unit 116 may notify that the operation of the second heat source unit 20B does not adversely affect the operation of the first heat source unit 20A.

When the determination unit 114 determines that the operation of the second heat source unit 20B adversely affects the operation of the first heat source unit 20A as a result of the comparison between the first temperature and the reference temperature (Step S8), the notification unit 116 notifies that the operation of the second heat source unit 20B adversely affects the operation of the first heat source unit 20A (Step S9). Then, the evaluation process of the refrigerant circuit apparatus evaluation system 100 ends.

When the notification unit 116 notifies that the operation of the second heat source unit 20B adversely affects the operation of the first heat source unit 20A, the worker who performs the installation work, or the like, of the heat source units 20A and 20B may move the first heat source unit 20A and/or the second heat source unit 20B based on the notification. Then, after moving the first heat source unit 20A and/or the second heat source unit 20B, the worker performs the evaluation process again by using the refrigerant circuit apparatus evaluation system 100 to confirm whether the first heat source unit 20A and the second heat source unit 20B have been moved to appropriate positions.

Furthermore, in the evaluation process according to the first example described above, the process from Steps S1 to S5 are continuously performed. However, this is not a limitation. For example, after the process of Steps S1 to S3 is performed, the operation of the first air-conditioning apparatus 1A may be temporarily stopped and, after a predetermined time has elapsed, the operations of the first air-conditioning apparatus 1A and the second air-conditioning apparatus 1B may be started at Step S4. However, when there is a large time difference between the execution time of Step S2 and the execution time of Step S5, there is a possibility that the outside air temperature changes and it becomes difficult to perform an accurate evaluation. Therefore, the execution time of Step S2 and the execution time of Step S5 are preferably short to the extent that the outside air temperature does not largely change.

Furthermore, here, the evaluation process by the refrigerant circuit apparatus evaluation system 100 including the operations of the first air-conditioning apparatus 1A and the second air-conditioning apparatus 1B is described. However, this is not a limitation. The evaluation process by the refrigerant circuit apparatus evaluation system 100 may be performed when there is, as information, the temperature (reference temperature) of the intake air of the first heat source unit 20A while the second air-conditioning apparatus 1B stops its operation and only the first air-conditioning apparatus 1A is operating and the temperature (the first temperature) of the intake air of the first heat source unit 20A while the first air-conditioning apparatus 1A and the second air-conditioning apparatus 1B are simultaneously operating. Therefore, the first air-conditioning apparatus 1A and the second air-conditioning apparatus 1B may be operated in advance to acquire the reference temperature and the first temperature and accumulate them in the control unit 60A of the first air-conditioning apparatus 1A, and then the acquisition unit 112 of the evaluation apparatus 110 may acquire the reference temperature and the first temperature from the control unit 60A. Then, the determination unit 114 of the evaluation apparatus 110 may determine whether the operation of the second heat source unit 20B has an adverse effect on the operation of the first heat source unit 20A based on the reference temperature and the first temperature acquired by the acquisition unit 112.

(4-2) Second Example

A second example of the evaluation process by the refrigerant circuit apparatus evaluation system 100 will be described with reference to FIG. 5. Furthermore, the flow of the evaluation process described here is merely an example. Further, the content of the evaluation process according to the second example may be changed as appropriate. Moreover, although the description may be omitted here to avoid redundant descriptions, the content described for the evaluation process according to the first example may be applied to the second example as long as there is no contradiction.

In order to perform the evaluation process, the operation of the first air-conditioning apparatus 1A is started (Step S11). Furthermore, the operation of the second air-conditioning apparatus 1B is also started (Step S12). Further, for example, the order of Steps S11 and S12 may be reversed, or both steps may be executed simultaneously.

The operations of the first air-conditioning apparatus 1A and the second air-conditioning apparatus 1B may be a cooling operation or heating operation. Here, it is assumed that the first air-conditioning apparatus 1A and the second air-conditioning apparatus 1B perform the cooling operation.

Subsequently, the acquisition unit 112 of the evaluation apparatus 110 acquires the outside air temperature measured by the outside air temperature sensor 120 (Step S13). Then, the evaluation apparatus 110 stores the outside air temperature acquired by the acquisition unit 112 as the reference temperature in the storage unit 118 (Step S14). Further, for example, the reference temperature stored in the storage unit 118 may be data on the outside air temperature To measured by the outside air temperature sensor 120 at a certain moment. Alternatively, the reference temperature stored in the storage unit 118 may be a mean value, an intermediate value, or the like, of the outside air temperatures To measured by the outside air temperature sensor 120 at multiple time points.

Alternatively, Steps S13 and S14 do not need to be performed after the execution of Steps S11 and S12 and may be performed before the execution of Steps S11 and S12.

Subsequently, at Step S15, the acquisition unit 112 acquires the measurement value of the inlet air temperature sensor 47 transmitted from the control unit 60A of the first air-conditioning apparatus 1A, i.e., the temperature of the intake air taken into the first heat source unit 20A (Step S15). The process at Step S15 is similar to the process at Step S5 according to the first example. Here, as in the description of Step S5, the temperature of the intake air acquired by the acquisition unit 112 at Step S15 is referred to as the first temperature.

Subsequently, the determination unit 114 compares the first temperature with the reference temperature stored in the storage unit 118 (Step S16).

Then, when the condition of the first temperature≤(the reference temperature+β (β>0)) is satisfied, the determination unit 114 determines that the operation of the second heat source unit 20B does not adversely affect the operation of the first heat source unit 20A of the first air-conditioning apparatus 1A (Step S17). Conversely, when the condition of the first temperature≤(the reference temperature+β) is not satisfied (in other words, when (the first temperature>the reference temperature+β)), the determination unit 114 determines that the operation of the second heat source unit 20B adversely affects the operation of the first heat source unit 20A of the first air-conditioning apparatus 1A (Step S18).

The reason why the determination unit 114 performs such a process will be described in detail.

During the cooling operation, the second heat source unit 20B of the second air-conditioning apparatus 1B exhausts the air heated by the refrigerant in the heat-source heat exchanger 26 to the outside of the casing 21. Therefore, when the installation position of either the first heat source unit 20A or the second heat source unit 20B is not appropriate and the exhaust air of the second heat source unit 20B is taken into the first heat source unit 20A as intake air, the temperature of the intake air of the first heat source unit 20A becomes higher than the reference temperature (the outside air temperature To). Therefore, by comparing the first temperature with the reference temperature, it is possible to determine whether the exhaust air of the second heat source unit 20B is taken into the first heat source unit 20A as intake air or not. Furthermore, as an increase in the temperature of the air taken into the first heat source unit 20A during the cooling operation causes an increase in the temperature of the heat source air for cooling the refrigerant, the operation of the first heat source unit 20A is adversely affected by the operation of the second heat source unit 20B, which results in a decrease in the operation efficiency of the first air-conditioning apparatus 1A.

Furthermore, here, one reason why the first temperature is compared with (the reference temperature+β (β>0)) instead of the reference temperature is to prevent the occurrence of the situation where the determination unit 114 determines that a measurement error of the inlet air temperature sensor 47 or the outside air temperature sensor 120, or the difference between the temperature of the ambient air at the measurement place by the inlet air temperature sensor 47 and the temperature of the ambient air at the measurement place by the outside air temperature sensor 120 as a situation where the operation of the second heat source unit 20B adversely affects the operation of the first heat source unit 20A. Furthermore, another reason is that, even when the exhaust air of the heat source unit 20B is taken into the heat source unit 20A as intake air, a small increase in the temperature of the inlet air substantially has no effect on the operating performance of the first air-conditioning apparatus 1A. The value of β may be determined as appropriate.

When the determination unit 114 determines that the operation of the second heat source unit 20B does not adversely affect the operation of the first heat source unit 20A as a result of the comparison between the first temperature and the reference temperature (Step S17), the evaluation process of the refrigerant circuit apparatus evaluation system 100 ends. Furthermore, although not illustrated, when the process proceeds to Step S17, for example, the notification unit 116 may notify that the operation of the second heat source unit 20B does not adversely affect the operation of the first heat source unit 20A.

When the determination unit 114 determines that the operation of the second heat source unit 20B adversely affects the operation of the first heat source unit 20A as a result of the comparison between the first temperature and the reference temperature (Step S18), the notification unit 116 notifies that the operation of the second heat source unit 20B adversely affects the operation of the first heat source unit 20A (Step S19). Then, the evaluation process of the refrigerant circuit apparatus evaluation system 100 ends.

In the evaluation process according to the second example, there is no need to operate only the first air-conditioning apparatus 1A to acquire the operation data, and therefore the refrigerant circuit apparatus evaluation system 100 may complete the evaluation process in a relatively short time.

(4-3) Third Example

A third example of the evaluation process by the refrigerant circuit apparatus evaluation system 100 will be described with reference to FIG. 6. Furthermore, the flow of the evaluation process described here is merely an example. Further, the content of the evaluation process according to the third example may be changed as appropriate. Moreover, although the description may be omitted here to avoid redundant descriptions, the content described for the evaluation processes according to the first example and the second example may be applied to the third example as long as there is no contradiction.

According to the third example, in order to perform the evaluation process, the operation of the first air-conditioning apparatus 1A is started (Step S21) and, after a predetermined time (e.g., 10 minutes) has elapsed, the operation of the first air-conditioning apparatus 1A is stopped (Step S24). The operation of the first air-conditioning apparatus 1A may be a cooling operation or a heating operation. Here, the case where the first air-conditioning apparatus 1A performs the cooling operation will be described as an example.

The acquisition unit 112 of the evaluation apparatus 110 acquires the data on the measurement value (the space temperature Tr) of the space temperature sensor 57 transmitted from the control unit 60A of the first air-conditioning apparatus 1A from when the operation of the first air-conditioning apparatus 1A is started at Step S21 to when the operation is stopped at Step S24 (Step S22). The evaluation apparatus 110 stores the data on the space temperature Tr acquired by the acquisition unit 112 as reference data in the storage unit 118 (Step S23).

For example, the data stored in the storage unit 118 is time-series data on the space temperature Tr from the start time of the operation to the end time of the operation. Furthermore, the time-series data may be (continuous) data on the space temperatures Tr acquired at a relatively short time interval or may be (discrete) data on the space temperatures Tr acquired at a relatively long time interval. Moreover, for example, the data stored in the storage unit 118 may be the space temperature at the start time of the operation of the first air-conditioning apparatus 1A and the space temperature at the time when a predetermined time has elapsed from the start of the operation.

After the operation of the first air-conditioning apparatus 1A is stopped at Step S24, the operation of the second air-conditioning apparatus 1B is started (Step S25). For example, the operation of the second air-conditioning apparatus 1B may be a cooling operation or heating operation. Here, the case where the second air-conditioning apparatus 1B performs the cooling operation same as the first air-conditioning apparatus 1A will be described as an example.

Subsequently, after a predetermined time has elapsed from the start of the operation of the second air-conditioning apparatus 1B, the operation of the first air-conditioning apparatus 1A is started (Step S26), and after the predetermined time has elapsed, the operation of the first air-conditioning apparatus 1A is stopped (Step S29). For example, specifically, after the second air-conditioning apparatus 1B ends the start-up control and the normal operation is started, the operation of the first air-conditioning apparatus 1A is started, and after a predetermined time (e.g., 10 minutes) has elapsed, the operation of the first air-conditioning apparatus 1A is stopped.

Please note that, when the first air-conditioning apparatus 1A performs the cooling operation at Step S21, the first air-conditioning apparatus 1A also performs the cooling operation at Step S26, and when the first air-conditioning apparatus 1A performs the heating operation at Step S21, the first air-conditioning apparatus 1A also performs the heating operation at Step S26.

Furthermore, the operation condition of the first air-conditioning apparatus 1A at Step S26 is preferably substantially the same as the operation condition of the first air-conditioning apparatus 1A at Step S21. For example, when the first air-conditioning apparatus 1A includes the plurality of utilization units 50, the number of the utilization units 50 operated at Step S26 is preferably the same as the number of the utilization units 50 operated at Step S21. Furthermore, the outside air temperature To and the space temperature Tr at the time when the operation of the first air-conditioning apparatus 1A is started at Step S26 preferably has a small difference from the outside air temperature To and the space temperature Tr at the time when the operation of the first air-conditioning apparatus 1A is started at Step S21.

Subsequently, the acquisition unit 112 of the evaluation apparatus 110 acquires the data on the measurement value (the space temperature Tr) of the space temperature sensor 57 transmitted from the control unit 60A of the first air-conditioning apparatus 1A from when the operation of the first air-conditioning apparatus 1A is started at Step S26 to when the operation is stopped at Step S29 (Step S27). The evaluation apparatus 110 stores the data on the space temperature Tr acquired by the acquisition unit 112 as first data in the storage unit 118 (Step S28). The first data is preferably data corresponding to the reference data. In short, when the reference data is time-series data on the space temperatures Tr acquired at a predetermined time interval, the first data is preferably also time-series data on the space temperatures Tr acquired at the same time interval.

Subsequently, the determination unit 114 compares the first data with the reference data to determine whether the performance of the first air-conditioning apparatus 1A has degraded during the operation of the second air-conditioning apparatus 1B (Step S30).

For example, the determination unit 114 compares the temperature change of the space temperature Tr per unit time in the first data with the temperature change of the space temperature Tr per unit time in the reference data and determines whether the performance of the first air-conditioning apparatus 1A has degraded during the operation of the second air-conditioning apparatus 1B. For example, when the temperature decrease in the space temperature Tr per unit time in the first data is smaller than the temperature decrease in the space temperature Tr per unit time in the reference data, the determination unit 114 determines that the performance of the first air-conditioning apparatus 1A has degraded when the first air-conditioning apparatus 1A and the second air-conditioning apparatus 1B are simultaneously operating as compared with when the second air-conditioning apparatus 1B stops operation and the first air-conditioning apparatus 1A is operating. Conversely, when the temperature decrease in the space temperature Tr per unit time in the first data is equal to or more than the temperature decrease in the space temperature Tr per unit time in the reference data, the determination unit 114 determines that the performance of the first air-conditioning apparatus 1A has not degraded even when the first air-conditioning apparatus 1A and the second air-conditioning apparatus 1B are simultaneously operating. In other words, the determination unit 114 determines that the operation of the second heat source unit 20B has no adverse effect on the operation of the first heat source unit 20A when the temperature decrease in the space temperature Tr per unit time in the first data is equal to or more than the temperature decrease in the space temperature Tr per unit time in the reference data. Furthermore, in the comparison between the first data and the reference data, the process may be performed to determine that there is no adverse effect when the difference between the temperature decrease in the space temperature Tr per unit time in the first data and the temperature decrease in the space temperature Tr per unit time in the reference data is less than a predetermined amount even when the temperature decrease in the space temperature Tr per unit time in the first data is smaller than the temperature decrease in the space temperature Tr per unit time in the reference data. Further, when it is determined whether the performance of the first air-conditioning apparatus 1A has degraded when the first air-conditioning apparatus 1A and the second air-conditioning apparatus 1B are simultaneously operating, a correction based on the outside air temperature To may be performed considering the difference in the outside air temperature condition between when the reference data is acquired and when the first data is acquired.

Further, an index other than the degree of temperature decrease in the space temperature per unit time may be used to determine whether the performance of the first air-conditioning apparatus 1A has degraded when the first air-conditioning apparatus 1A and the second air-conditioning apparatus 1B are simultaneously operating. For example, the time it takes for the space temperature Tr to reach the set temperature Trs from a predetermined temperature may be used as an index for determining whether the performance of first air-conditioning apparatus 1A has degraded when the first air-conditioning apparatus 1A and the second air-conditioning apparatus 1B are simultaneously operating.

When it is determined at Step S30 that the performance of the first air-conditioning apparatus 1A has not degraded during the operation of the second air-conditioning apparatus 1B, the determination unit 114 determines that the operation of the second heat source unit 20B has no adverse effect on the operation of the first heat source unit 20A (Step S31). Conversely, when it is determined at Step S30 that the performance of the first air-conditioning apparatus 1A has degraded during the operation of the second air-conditioning apparatus 1B, the determination unit 114 determines that the operation of the second heat source unit 20B has an adverse effect on the operation of the first heat source unit 20A (Step S32).

When the determination unit 114 determines that the operation of the second heat source unit 20B does not adversely affect the operation of the first heat source unit 20A (Step S31), the evaluation process of the refrigerant circuit apparatus evaluation system 100 ends. Furthermore, although not illustrated, when the process proceeds to Step S31, the notification unit 116 may notify that the operation of the second heat source unit 20B does not adversely affect the operation of the first heat source unit 20A.

When the determination unit 114 determines that the operation of the second heat source unit 20B adversely affects the operation of the first heat source unit 20A (Step S32), the notification unit 116 notifies that the operation of the second heat source unit 20B adversely affects the operation of the first heat source unit 20A (Step S33). Then, the evaluation process of the refrigerant circuit apparatus evaluation system 100 ends.

(5) Feature 5-1

The refrigerant circuit apparatus evaluation system 100 according to the present embodiment includes the acquisition unit 112 and the determination unit 114. The acquisition unit 112 acquires the operation data on the first air-conditioning apparatus 1A. The first air-conditioning apparatus 1A includes the first heat source unit 20A. The determination unit 114 determines whether the operation of the second heat source unit 20B different from the first heat source unit 20A has an adverse effect on the operation of the first heat source unit 20A based on the operation data on the first air-conditioning apparatus 1A acquired by the acquisition unit 112 when the first air-conditioning apparatus 1A and the second air-conditioning apparatus 1B including the second heat source unit 20B are simultaneously operating.

The refrigerant circuit apparatus evaluation system 100 according to the present embodiment may accurately determine whether the operation of the second heat source unit 20B has an adverse effect on the operation of the first heat source unit 20A based on the actual operation data on the first air-conditioning apparatus 1A rather than the experience, or the like, of the installation worker of the air-conditioning apparatuses 1A and 1B. In other words, the refrigerant circuit apparatus evaluation system 100 may accurately determine whether the installation state of the first heat source unit 20A and/or the second heat source unit 20B is appropriate.

Furthermore, the use of the determination result of the refrigerant circuit apparatus evaluation system 100 may make it easy to install one of the heat source units 20A and 20B at a position so as to be less likely to be adversely affected by the operation of the other one of the heat source units 20A and 20B, for example, even when the heat source units 20A and 20B are installed in a limited space.

5-2

In the refrigerant circuit apparatus evaluation system 100 that performs the evaluation process according to the first example and the second example of the present embodiment, the operation data on the first air-conditioning apparatus 1A includes the date on the temperature of the air taken into the first heat source unit 20A. The determination unit 114 determines whether the operation of the second heat source unit 20B has an adverse effect on the operation of the first heat source unit 20A based on the temperature of the air taken into the first heat source unit 20A.

In the refrigerant circuit apparatus evaluation system 100 that performs the evaluation process according to the first embodiment and the second embodiment, it is relatively easy to determine whether the operation of the second heat source unit 20B has an adverse effect on the operation of the first heat source unit 20A based on the data on the temperature of the air taken into the first heat source unit 20A.

5-3

In the refrigerant circuit apparatus evaluation system 100 that performs the evaluation process according to the second example of the present embodiment, the acquisition unit 112 further acquires the outside air temperature during the operation of the first air-conditioning apparatus 1A. The determination unit 114 determines whether the operation of the second heat source unit 20B has an adverse effect on the operation of the first heat source unit 20A based on the outside air temperature and the temperature of the air taken into the first heat source unit 20A.

In the refrigerant circuit apparatus evaluation system 100 that performs the evaluation process according to the second example, it is possible to accurately determine whether the operation of the second heat source unit 20B has an adverse effect on the operation of the first heat source unit 20A based on the data on the outside air temperature and the temperature of the air taken into the first heat source unit 20A.

5-4

In the refrigerant circuit apparatus evaluation system 100 that performs the evaluation process according to the first example and the third example of the present embodiment, the determination unit 114 determines whether the operation of the second heat source unit 20B has an adverse effect on the operation of the first heat source unit 20A based on the operation data on the first air-conditioning apparatus 1A acquired by the acquisition unit 112 when the first air-conditioning apparatus 1A and the second air-conditioning apparatus 1B are simultaneously operating and the operation data on the first air-conditioning apparatus 1A acquired by the acquisition unit 112 when the second air-conditioning apparatus 1B stops operation and the first air-conditioning apparatus 1A is operating.

In the refrigerant circuit apparatus evaluation system 100 that performs the evaluation process according to the first example and the third example, it is possible to accurately determine whether the operation of the second heat source unit 20B has an adverse effect on the operation of the first heat source unit 20A based on the operation data on the first air-conditioning apparatus 1A when only the first air-conditioning apparatus 1A is operating and the operation data on the first air-conditioning apparatus 1A when the first air-conditioning apparatus 1A and the second air-conditioning apparatus 1B are simultaneously operating.

5-5

The refrigerant circuit apparatus evaluation system 100 according to the present embodiment includes the notification unit 116. In a case where the determination unit 114 determines that the operation of the second heat source unit 20B adversely affects the operation of the first heat source unit 20A, the notification unit 116 notifies that the operation of the second heat source unit 20B adversely affects the operation of the first heat source unit 20A.

In the refrigerant circuit apparatus evaluation system 100 according to the present embodiment, as a notification is given that the operation of the second heat source unit 20B adversely affects the operation of the first heat source unit 20A, it is possible to prevent failing to recognize the inappropriate installation states of the heat source units 20A and 20B.

(6) Modification (6-1) Modification A

According to the above-described embodiment, the acquisition unit 112 acquires the operation data on the first air-conditioning apparatus 1A from the control unit 60A, but the acquisition unit 112 may acquire the operation data on the first air-conditioning apparatus 1A by another method.

For example, the refrigerant circuit apparatus evaluation system 100 may include a sensor corresponding to the inlet air temperature sensor 47 and/or a sensor corresponding to the space temperature sensor 57. In other words, the refrigerant circuit apparatus evaluation system 100 may include a sensor different from the sensor included in the first air-conditioning apparatus 1A and independent from the first air-conditioning apparatus 1A. Furthermore, the determination unit 114 of the refrigerant circuit apparatus evaluation system 100 may use the measurement value, which is acquired by the acquisition unit 112, of the sensor different from the sensor included in the first air-conditioning apparatus 1A to determine whether the operation of the second heat source unit 20B has an adverse effect on the operation of the first heat source unit 20A.

Further, for example, the acquisition unit 112 of the refrigerant circuit apparatus evaluation system 100 may acquire not the operation data on the first air-conditioning apparatus 1A transmitted via the network 130, or the like, but the operation data on the first air-conditioning apparatus 1A input by the worker to an input device (not illustrated) of the evaluation apparatus 110.

(6-2) Modification B

According to the above embodiment, the determination unit 114 only determines whether the operation of the second heat source unit 20B has an adverse effect on the operation of the first heat source unit 20A. However, this is not a limitation, and the determination unit 114 may also determine the degree of adverse effect of the operation of the second heat source unit 20B on the operation of the first heat source unit 20A. For example, according to the first example in the above-described embodiment, the determination unit 114 may make a stepwise determination on the degree of adverse effect such that the degree of adverse effect increases as the first temperature increases with respect to the value of the reference temperature.

(6-3) Modification C

In the example described according to the above embodiment, both the first refrigerant circuit apparatus and the second refrigerant circuit apparatus are air-conditioning apparatuses, but for example the first refrigerant circuit apparatus and the second refrigerant circuit apparatus may be refrigerant circuit apparatuses of different types. For example, the first refrigerant circuit apparatus may be an air-conditioning apparatus, and the second refrigerant circuit apparatus may be a hot water supply apparatus.

(6-4) Modification D

According to the above embodiment, the acquisition unit 112 acquires the outside air temperature measured by the outside air temperature sensor 120, but the method for acquiring the outside air temperature is not limited thereto. For example, the acquisition unit 112 may acquire, as the outside air temperature, information on the outside air temperature provided by an organization that provides weather information.

<Note>

Although the embodiments of the present disclosure have been described above, it is understood that various modifications may be made to forms and details without departing from the spirit and scope of the present disclosure described in claims.

REFERENCE SIGNS LIST

1A First air-conditioning apparatus (first refrigerant circuit apparatus)
1B Second air-conditioning apparatus (second refrigerant circuit apparatus)
20A First heat source unit
20B Second heat source unit
100 Refrigerant circuit apparatus evaluation system
112 Acquisition unit
114 Determination unit
116 Notification unit

CITATION LIST

Patent Literature

[Patent Literature 1] Japanese Unexamined Patent Publication No. 2000-028181

The invention claimed is:

1. A refrigerant circuit apparatus evaluation system comprising:

memory storing an evaluation program;

processing circuitry configured to execute the evaluation program so as to:

acquire operation data on a first refrigerant circuit apparatus comprising a first refrigerant circuit including a first heat source unit having a first compressor; and determine whether an operation of a second heat source unit different from the first heat source unit has an effect on an operation of the first heat source unit based on the operation data on the first refrigerant circuit apparatus acquired by the processing circuitry when the first refrigerant circuit apparatus and a second refrigerant circuit apparatus comprising a second refrigerant circuit including the second heat source unit having a second compressor are simultaneously operating, wherein the processing circuitry is configured to determine whether the operation of the second heat source unit has the effect on the operation of the first heat source unit based on the operation data on the first refrigerant circuit apparatus acquired by the processing circuitry when the first refrigerant circuit apparatus and the second refrigerant circuit apparatus are simultaneously operating and operation data on the first refrigerant circuit apparatus acquired by the processing circuitry when the second refrigerant circuit apparatus stops operation and the first refrigerant circuit apparatus is operating, a state where the first refrigerant circuit apparatus is operating is a state where the first compressor is operating and the refrigerant circulates in the first refrigerant circuit, and a state where the second refrigerant circuit apparatus is operating is a state where the second compressor is operating and the refrigerant circulates in the second refrigerant circuit.

2. The refrigerant circuit apparatus evaluation system according to claim 1, wherein the operation data on the first refrigerant circuit apparatus includes data on a temperature of air taken into the first heat source unit, and the processing circuitry is configured to determine whether the operation of the second heat source unit has the effect on the operation of the first heat source unit based on the temperature of the air taken into the first heat source unit.

3. The refrigerant circuit apparatus evaluation system according to claim 2, wherein the processing circuitry is further configured to acquire an outside air temperature during an operation of the first refrigerant circuit apparatus, and the processing circuitry is configured to determine whether the operation of the second heat source unit has the effect on the operation of the first heat source unit based on the outside air temperature and the temperature of the air taken into the first heat source unit.

4. The refrigerant circuit apparatus evaluation system according to claim 3, wherein the processing circuitry is further configured to give a notification that the operation of the second heat source unit has the effect on the operation of the first heat source unit, in a case where the processing circuitry determines that the operation of the second heat source unit has the effect on the operation of the first heat source unit.

5. The refrigerant circuit apparatus evaluation system according to claim 3, wherein the outside air temperature is measured by an outdoor air temperature sensor installed independently of the first refrigerant circuit apparatus and the second refrigerant circuit apparatus.

6. The refrigerant circuit apparatus evaluation system according to claim 2, wherein the processing circuitry is further configured to give a notification that the operation of the second heat source unit has the effect on the operation of the first heat source unit, in a case where the processing circuitry determines that the operation of the second heat source unit has the effect on the operation of the first heat source unit.

7. The refrigerant circuit apparatus evaluation system according to claim 2, wherein the temperature of air taken into the first heat source unit is measured by a first sensor disposed around an intake port of a casing of the first heat source unit.

8. The refrigerant circuit apparatus evaluation system according to claim 1, wherein the processing circuitry is further configured to give a notification that the operation of the second heat source unit has the effect on the operation of the first heat source unit, in a case where the processing circuitry determines that the operation of the second heat source unit has the effect on the operation of the first heat source unit.

* * * * *